US011804240B2

(12) United States Patent
Chang et al.

(10) Patent No.: US 11,804,240 B2
(45) **Date of Patent: *Oct. 31, 2023**

(54) METHODS AND SYSTEMS FOR HUMAN ACTIVITY TRACKING

(71) Applicant: Honeywell International Inc., Charlotte, NC (US)

(72) Inventors: Hisao M. Chang, Medina, MN (US); Amit Kulkarni, Medina, MN (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/893,583

(22) Filed: Aug. 23, 2022

(65) Prior Publication Data

US 2022/0399032 A1 Dec. 15, 2022

Related U.S. Application Data

(63) Continuation of application No. 17/114,260, filed on Dec. 7, 2020, now Pat. No. 11,450,340.

(51) Int. Cl.
*G10L 25/51* (2013.01)
*G10L 25/78* (2013.01)
(Continued)

(52) U.S. Cl.
CPC ..... *G10L 25/51* (2013.01); *F24F 11/49* (2018.01); *F24F 11/63* (2018.01); *G10L 25/72* (2013.01); *G10L 25/78* (2013.01)

(58) Field of Classification Search
None
See application file for complete search history.

(56) References Cited

U.S. PATENT DOCUMENTS 6,775,642 B2 8/2004 Remboski et al.
8,643,539 B2 2/2014 Pauly et al.
(Continued)

FOREIGN PATENT DOCUMENTS

CN 103366738 B 8/2016
CN 205600145 U 9/2016
(Continued)

OTHER PUBLICATIONS

Saimurugan, et al; "Intelligent Fault Diagnosis for Rotating Machinery Based on Fusion of Sound Signal", International Journal of Prognostics and Health Management, 10 pages, 2016.
(Continued)

*Primary Examiner* — Duc Nguyen
*Assistant Examiner* — Assad Mohammed
(74) *Attorney, Agent, or Firm* — Seager, Tufte & Wickhem, LLP

(57) ABSTRACT

Methods and systems for identifying human activity in a building. An illustrative method includes storing one or more room sound profiles for a room in a building based at least in part on background audio captured in the room without a presence of humans in the room. Background noise filters are generated for the room based on the room sound profiles. Real time audio may be captured from the room and filtered with at least one of the background noise filters. The filtered real time audio may be analyzed to identify one or more sounds associated with human activity in the room. A situation report may be generated based at least in part on the identified one or more sounds associated with human activity in the room and transmitted for use by a user.

20 Claims, 11 Drawing Sheets

(51) Int. Cl.

| | |
|---|---|
| ***F24F 11/49*** | (2018.01) |
| ***F24F 11/63*** | (2018.01) |
| ***G10L 25/72*** | (2013.01) |

(56) References Cited

U.S. PATENT DOCUMENTS

| | | | | |
|---|---|---|---|---|
| 8,938,404 | B2 | 1/2015 | Capman et al. | |
| 9,244,042 | B2 | 1/2016 | Rank | |
| 9,658,100 | B2 | 5/2017 | Park | |
| 9,830,932 | B1 | 11/2017 | Gunderson et al. | |
| 9,900,556 | B1 | 2/2018 | Scanlon et al. | |
| 10,354,655 | B1 | 7/2019 | White et al. | |
| 10,475,468 | B1 | 11/2019 | Yelchuru et al. | |
| 10,615,995 | B2 | 4/2020 | Yu | |
| 10,755,730 | B1 | 8/2020 | Maurer et al. | |
| 2005/0004797 | A1 | 1/2005 | Azencott | |
| 2010/0303254 | A1 | 12/2010 | Yoshizawa et al. | |
| 2012/0245927 | A1 | 9/2012 | Bondy | |
| 2014/0368643 | A1 | 12/2014 | Siegel et al. | |
| 2016/0091398 | A1 | 3/2016 | Pluemer | |
| 2016/0191268 | A1 | 6/2016 | Diebel | |
| 2016/0327522 | A1 | 11/2016 | Tanaka et al. | |
| 2016/0330062 | A1 | 11/2016 | Alloin et al. | |
| 2016/0379456 | A1* | 12/2016 | Nongpiur | G08B 13/1672 340/541 |
| 2018/0040222 | A1 | 2/2018 | Findlay et al. | |
| 2019/0139565 | A1* | 5/2019 | Chang | G08B 13/1672 |
| 2020/0066257 | A1 | 2/2020 | Smith et al. | |
| 2020/0252233 | A1 | 8/2020 | O'Keeffe | |
| 2020/0301378 | A1 | 9/2020 | McQueen et al. | |

FOREIGN PATENT DOCUMENTS

| | | | |
|---|---|---|---|
| EP | 3193317 | A1 | 7/2017 |
| WO | 2019159106 | A1 | 8/2019 |

OTHER PUBLICATIONS

Pan, et al; "Cognitive Acoustic Analytics Service for Internet of Things", 2017 IEEE International Conference on Cognitive Computing (ICCC), 8 pages, Jun. 25-30, 2017.

Scardapane et al; "Microphone Array Based Classification for Security Monitoring in Unstructured Environments", AEU __ International Journal of Electronics and Communications, vol. 69, Issue 11, 9 pages, Nov. 2015.

Ntalampiras, et al; "On Acoustic Surveillance of Hazardous Situations", 2009 IEEE International Conference on Acoustics, Speech and Signal Processing, 5 pages, Apr. 19-24, 2009.

Maijala, et al; "Environmental Noise Monitoring Using Source Classification in Sensors", Applied Acoustics, vol. 129, 10 pages, Jan. 2018.

* cited by examiner

METHODS AND SYSTEMS FOR HUMAN ACTIVITY TRACKING

METHODS AND SYSTEMS FOR HUMAN ACTIVITY TRACKING

This is a continuation of co-pending U.S. patent application Ser. No. 17/114,260, filed Dec. 7, 2020, and entitled "METHODS AND SYSTEMS FOR HUMAN ACTIVITY TRACKING", which is incorporated herein by reference.

TECHNICAL FIELD

The disclosure generally relates to activity tracking, and more particularly to systems and methods for monitoring human activity in buildings and/or public spaces.

BACKGROUND

Modern building management systems are often communicatively coupled with one or more edge sensors, such as but not limited to motion sensors, light sensors, temperature sensors, humidity sensors and/or sensors. What would be desirable is to utilize edge sensors of a building management system to provide a human activity tracking system.

SUMMARY

This disclosure generally relates to activity monitoring systems, and more particularly to systems and methods to monitor human activity within a building. In one example, a method for identifying human activity in a building includes storing one or more room sound profiles for a room in a building. The one or more room sound profiles may be based at least in part on background audio captured in the room without a presence of humans in the room. The background audio may include the sound of equipment of a building management system. Based on the one or more room sound profiles for the room, generating at least one background noise filter for the room. Real time audio from the room in the building may be captured, the real time audio may be filtered with one or more of the at least one background noise filter for the room, and the filtered real time audio may then be analyzed to identify one or more sounds associated with human activity in the room. In some cases, a situation report may be generated based at least in part on the identified one or more sounds associated with human activity in the room. The situation report may be transmitted for use by a user.

Alternatively or additionally to any of the examples above, in another example, analyzing the filtered real time audio may include comparing the filtered real time audio with one or more sound classification models.

Alternatively or additionally to any of the examples above, in another example, the one or more sound classification models may include one or more of a human voice model, a laughter model, an illness detection module, a human activity model, and/or a running water model.

Alternatively or additionally to any of the examples above, in another example, the one or more room sound profiles may be based at least in part on background audio captured in the room during each of a plurality of time periods over at least a 24-hour time period.

Alternatively or additionally to any of the examples above, in another example, the one or more room sound profiles are may be at least in part on background audio captured in the room during each of a plurality of time periods over a plurality of days.

Alternatively or additionally to any of the examples above, in another example, the one or more room sound profiles may be correlated to one or more operating cycles of one or more components of a Heating, Ventilation, and/or Air Conditioning (HVAC) system servicing the room.

Alternatively or additionally to any of the examples above, in another example, the method may further comprise generating an alert when one or more of the identified sounds associated with human activity in the room are determined to be abnormal and transmitting the alert.

Alternatively or additionally to any of the examples above, in another example, the alert may include one or more of a building occupant health alert, a workplace disturbance alert, a cleaning alert, and a gunshot-like sound alert.

Alternatively or additionally to any of the examples above, in another example, the situation report may further comprise an absence of an expected sound in the room.

Alternatively or additionally to any of the examples above, in another example, the method may further comprise transmitting an alert in response to the absence of the expected sound in the room.

Alternatively or additionally to any of the examples above, in another example, the one or more sounds associated with human activity includes one or more of talking, yelling, sneezing, coughing, running water, keyboard clicking, operation of cleaning equipment, and gunshot-like sounds.

In another example, a method for identifying human activity in a building includes capturing real time audio from each of a plurality of rooms in the building, filtering the real time audio with one or more background noise filters, wherein the one or more background noise filters are based at least in part on background audio captured in each of the plurality of rooms without a presence of humans in the plurality of rooms, comparing the filtered real time audio with one or more sound classification models to classify the real time audio into one or more classifications of detected human activity in each of the plurality of rooms, generating a situation report including at least one classification of detected human activity, and transmitting the situation report for use by a user.

Alternatively or additionally to any of the examples above, in another example, the situation report may include a heat map of the detected human activity across the plurality of rooms in the building.

Alternatively or additionally to any of the examples above, in another example, the method may further comprise determining when one or more of the detected human activity is abnormal and transmitting an alert when one or more of the detected human activity is determined to be abnormal.

Alternatively or additionally to any of the examples above, in another example, determining when one or more of the detected human activity is abnormal may include referencing an expected occupancy number for one or more of the plurality of rooms.

Alternatively or additionally to any of the examples above, in another example, the one or more background noise filters are configured to remove expected noises produced by one or more components of a building management system from the real time audio.

Alternatively or additionally to any of the examples above, in another example, the one or more background noise filters may include a background noise filter for each of two or more operational cycles of one or more components of a building management system.

In another example, a system for identifying human activity in a building includes one or more sound sensors positioned about a room and a controller having a memory. The controller may be configured to initiate a calibration mode. While in the calibration mode, the controller may be configured to collect background audio from the room from at least one of the one or more sound sensors without a presence of humans in the room, and generate one or more background noise filter based at least in part on the background audio collected from the room. The controller may be further configured to initiate an operational mode. While in said operational mode, the controller may be configured to capture real time audio of the room with at least one of the one or more sound sensors, filter the real time audio with at least one of the one or more background noise filter, analyze the filtered real time audio to identify one or more sounds associated with human activity in the room, determine when one or more sounds associated with human activity are abnormal, and generate and transmit an alert when one or more sounds associated with human activity in the room is determined to be abnormal.

Alternatively or additionally to any of the examples above, in another example, the one or more background noise filter may include a background noise filter for each of two or more operational cycles of one or more components of a Heating, Ventilation, and/or Air Conditioning (HVAC) system servicing the room.

Alternatively or additionally to any of the examples above, in another example, the one or more background noise filters may be based at least in part on background audio collected in the room during each of a plurality of time periods over at least a 24-hour time period.

The preceding summary is provided to facilitate an understanding of some of the features of the present disclosure and is not intended to be a full description. A full appreciation of the disclosure can be gained by taking the entire specification, claims, drawings, and abstract as a whole.

BRIEF DESCRIPTION OF THE DRAWINGS

The disclosure may be more completely understood in consideration of the following detailed description of various embodiments in connection with the accompanying drawings, in which.

Figure 1:
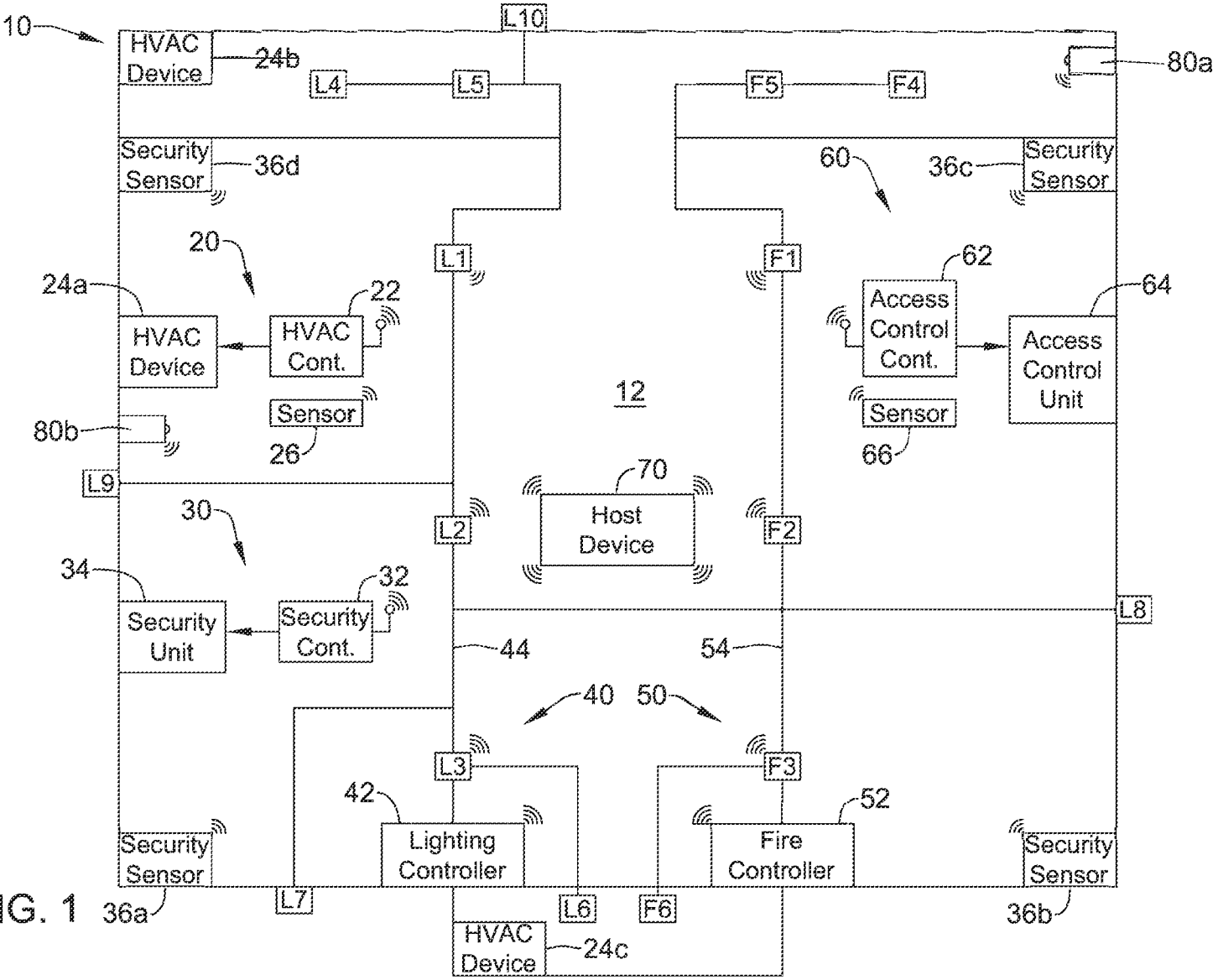
FIG. 1 is a schematic view of an illustrative building or other structure that includes a building management system (BMS) that controls client devices servicing the building.

While the disclosure is amenable to various modifications and alternative forms, specifics thereof have been shown by way of example in the drawings and will be described in detail. It should be understood, however, that the intention is not to limit aspects of the disclosure to the particular embodiments described. On the contrary, the intention is to cover all modifications, equivalents, and alternatives falling within the spirit and scope of the disclosure.

DESCRIPTION

The following detailed description should be read with reference to the drawings in which similar elements in different drawings are numbered the same. The description and the drawings, which are not necessarily to scale, depict illustrative embodiments and are not intended to limit the scope of the disclosure. The illustrative embodiments depicted are intended only as exemplary. Some or all of the features of any illustrative embodiment can be incorporated into other illustrative embodiments unless clearly stated to the contrary.

The various systems and/or methods described herein may be implemented or performed with a general purpose processor, a digital signal processor (DSP), an application specific integrated circuit (ASIC), a field programmable gate array signal (FPGA) or other programmable logic device, discrete gate or transistor logic, discrete hardware components, or any combination thereof designed to perform the functions described herein. A general purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

In some cases, methods or systems may utilize a dedicated processor or controller. In other cases, methods or systems may utilize a common or shared controller. Whether a system or method is described with respect to a dedicated controller/processor or a common controller/processor, each method or system can utilize either or both a dedicated controller/processor or a common controller/processor. For example, single controller/processor can be used for a single method or system or any combination of methods or systems. In some cases, system or method may be implemented in a distributed system, where parts of the system or method are distributed among various components of the distributed system. For example, some parts of a method may be performed locally, while other parts may be performed by a remote device such as a remote server. These are just examples.

In commercial buildings or building complexes, there can be many people, for example, hundreds or thousands of people, in different rooms/spaces on different floors who are performing their business or daily tasks. Their speech, laughter, coughing/sneezing, and/or work tasks create audio trails which may be correlated to a type of activity, a level of activity, an event, an incident, etc. The detection of these human activities with respect to a room or space in real time can provide valuable information to the building owners/operators so that the occupants' work experience and/or safety can be enhanced. A modern building management system (BMS) is wired to one or more different edge sensors such as, but not limited to, motion sensors, light sensors, temperature sensors, humidity sensors and/or sensors. For example, motion sensors may be provided in motion-based lighting switches.

In accordance with the present disclosure, a BMS edge network may include microphones, microphones embedded in ceiling lighting devices, microphones associated with motion sensors, and/or other sound sensors distributed about the building. In some cases, there may be tens, hundreds, or thousands of microphones embedded into the integrated ceiling light control devices in every room and/or work area throughout a building or building complex. The sound observed at these microphones or sound sensors may be used to generate a simple "heat map" of sounds in every room or space in the building. However, it can be difficult to reliability identify human activities in the building using simple noise "heat maps" because background noise in each room such as generated by the heating, ventilation, and air condition (HVAC) equipment of the Building Management System can dominate over the sounds produced by human activities. As such, and in some cases, it is contemplated that an automated sound profiling system may be trained to learn and recognize the sounds from the HVAC and other equipment in the building. Using the background sound profiles to filter out the background sounds, sounds associated with human activities may be detected and/or identified.

FIG. 1 is a schematic view of an illustrative building or structure 10 that includes a building management system (BMS) 12 for controlling one or more client devices servicing the building or structure 10. The BMS 12, as described herein according to the various illustrative embodiments, may be used to control the one or more client devices in order to control certain environmental conditions (e.g., temperature, ventilation, humidity, lighting, security, etc.). Such a BMS 12 may be implemented in, for example, office buildings, factories, manufacturing facilities, distribution facilities, retail buildings, hospitals, health clubs, movie theaters, restaurants, and even residential homes, among other places.

The BMS 12 shown in FIG. 1 includes one or more heating, ventilation, and air conditioning (HVAC) systems 20, one or more security systems 30, one or more lighting systems 40, one or more fire systems 50, and one or more access control systems 60. These are just a few examples of systems that may be included or controlled by the BMS 12. In some cases, the BMS 12 may include more or fewer systems depending on the needs of the building. For example, some buildings may also include refrigeration systems or coolers.

In some cases, each system may include a client device configured to provide one or more control signals for controlling one or more building control components and/or devices of the BMS 12. For instance, in some cases, the HVAC system 20 may include an HVAC control device 22 used to communicate with and control one or more HVAC devices 24*a*, 24*b*, and 24*c* (collectively, 24) for servicing the HVAC needs of the building or structure 10. While the HVAC system 20 is illustrated as including three devices, it should be understood that the structure may include fewer than three or more than three devices 24, as desired. Some illustrative devices may include, but are not limited to a furnace, a heat pump, an electric heat pump, a geothermal heat pump, an electric heating unit, an air conditioning unit, a roof top unit, a humidifier, a dehumidifier, an air exchanger, an air cleaner, a damper, a valve, blowers, fans, motors, air scrubbers, ultraviolet (UV) lights, and/or the like. The HVAC system 20 may further include a system of ductwork and air vents (not explicitly shown). The HVAC system 20 may further include one or more sensors or devices 26 configured to measure parameters of the environment to be controlled. The HVAC system 20 may include more than one sensor or device of each type, as needed to control the system. It is contemplated that large buildings, such as, but not limited to an office building, may include a plurality of different sensors in each room or within certain types of rooms. The one or more sensors or devices 26 may include, but are not limited to, temperatures sensors, humidity sensors, carbon dioxide sensors, pressure sensors, occupancy sensors, proximity sensors, etc. Each of the sensor/devices 26 may be operatively connected to the control device 22 via a corresponding communications port (not explicitly shown). It is contemplated that the communications port may be wired and/or wireless. When the communications port is wireless, the communications port may include a wireless transceiver, and the control device 22 may include a compatible wireless transceiver. It is contemplated that the wireless transceivers may communicate using a standard and/or a proprietary communication protocol. Suitable standard wireless protocols may include, for example, cellular communication, ZigBee, Bluetooth, WiFi, IrDA, dedicated short range communication (DSRC), EnOcean, or any other suitable wireless protocols, as desired.

In some cases, the security system 30 may include a security control device 32 used to communicate with and control one or more security units 34 for monitoring the building or structure 10. The security system 30 may further include a number of sensors/devices 36*a*, 36*b*, 36*c*, 36*d* (collectively, 36). The sensor/devices 36 may be configured to detect threats within and/or around the building 10. In some cases, some of the sensor/devices 36 may be constructed to detect different threats. For example, some of the sensor/devices 36 may be limit switches located on doors and windows of the building 10, which are activated by entry of an intruder into the building 10 through the doors and windows. Other suitable security sensor/devices 36 may include fire, smoke, water, carbon monoxide, and/or natural gas detectors, to name a few. Still other suitable security system sensor/devices 36 may include motion sensors that detect motion of intruders in the building 10, noise sensors or microphones that detect the sound of breaking glass, security card pass systems, or electronic locks, etc. It is contemplated that the motion sensor may be a passive infrared (PIR) motion sensor, a microwave motion sensor, a millimeter wave indoor radar sensor, an ultrasonic motion sensor, a tomographic motion sensor, a video camera having motion detection software, a vibrational motion sensor, etc. In some cases, one or more of the sensor/devices 36 may include a video camera. In some cases, the sensor/devices 36 may include a horn or alarm, a damper actuator controller (e.g., that closes a damper during a fire event), a light controller for automatically turning on/off lights to simulate occupancy, and/or any other suitable device/sensor. These are just examples.

In some cases, the lighting system 40 may include a lighting control device 42 used to communicate with and control one or more light banks 44 having lighting units L1-L10 for servicing the building or structure 10. In some embodiments, one or more of the lighting units L1-L10 may be configured to provide visual illumination (e.g., in the visible spectrum) and one or more of the light units L1-L10 may be configured to provide ultraviolet (UV) light to provide irradiation, sometimes for killing pathogens on surfaces in the building. One or more of the light units L1-L10 may include a multi-sensor bundle, which may include, but is not limited to, humidity sensors, temperature sensors, microphones, motion sensors, etc. The lighting system 40 may include emergency lights, outlets, lighting, exterior lights, drapes, and general load switching, some of which are subject to "dimming" control which varies the amount of power delivered to the various building control devices.

In some cases, the fire system 50 may include a fire control device 52 used to communicate with and control one or more fire banks 54 having fire units F1-F6 for monitoring and servicing the building or structure 10. The fire system 50 may include smoke/heat sensors, a sprinkler system, warning lights, and so forth.

In some cases, the access control system 60 may include an access control device 62 used to communicate with and control one or more access control units 64 for allowing access in, out, and/or around the building or structure 10. The access control system 60 may include doors, door locks, windows, window locks, turnstiles, parking gates, elevators, or other physical barriers, where granting access can be electronically controlled. In some embodiments, the access control system 60 may include one or more sensors 66 (e.g., RFID, etc.) configured to allow access to the building or certain parts of the building 10.

In a simplified example, the BMS 12 may be used to control a single HVAC system 20, a single security system 30, a single lighting system 40, a single fire system 50, and/or a single access control system 60. In other embodiments, the BMS 12 may be used to communicate with and control multiple discrete building control devices 22, 32, 42, 52, and 62 of multiple systems 20, 30, 40, 50, 60. The devices, units, and controllers of the systems 20, 30, 40, 50, 60 may be located in different zones and rooms, such as a common space area (a lobby, a break room, etc.), in a dedicated space (e.g., offices, work rooms, etc.), or outside of the building 10. In some cases, the systems 20, 30, 40, 50, 60 may be powered by line voltage, and may be powered by the same or different electrical circuit. It is contemplated that the BMS 12 may be used to control other suitable building control components that may be used to service the building or structure 10.

According to various embodiments, the BMS 12 may include a host device 70 that may be configured to communicate with the discrete systems 20, 30, 40, 50, 60 of the BMS 12. In some cases, the host device 70 may be configured with an application program that assigns devices of the discrete systems to a particular device (entity) class (e.g., common space device, dedicated space device, outdoor lighting, unitary controller, and so on). In some cases, there may be multiple hosts. For instance, in some examples, the host device 70 may be one or many of the control devices 22, 32, 42, 52, 62. In some cases, the host device 70 may be a hub located external to the building 10 at an external or remote server also referred to as "the cloud."

In some cases, the building control devices 22, 32, 42, 52, 62 may be configured to transmit a command signal to its corresponding building control component(s) for activating or deactivating the building control component(s) in a desired manner. In some cases, the building control devices 22, 32, 42, 52, 62 may be configured to receive a classification of the building control component and may transmit a corresponding command signal(s) to their respective building control component in consideration of the classification of the building control component.

In some instances, the building control devices 22, 32, 62 may be configured to receive signals from one or more sensors 26, 36, 66 located throughout the building or structure 10. In some cases, the building control devices 42 and 52 may be configured to receive signals from one or more sensors operatively and/or communicatively coupled with the lighting units L1-L10 and the fire units F1-F6 located throughout the building or structure 10, respectively. In some cases, the one or more sensors may be integrated with and form a part of one or more of their respective building control devices 22, 32, 42, 52, 62. In other cases, one or more sensors may be provided as separate components from the corresponding building control device. In still other instances, some sensors may be separate components of their corresponding building control devices while others may be integrated with their corresponding building control device. These are just some examples. The building control devices 22, 32, 42, 52, 62 and the host device 70 may be configured to use signal(s) received from the one or more sensors to operate or coordinate operation of the various BMS systems 20, 30, 40, 50, 60 located throughout the building or structure 10. As will be described in more detail herein, the building control devices 22, 32, 42, 52, 62 and the host device 70 may be configured to use signal(s) received from the one or more sensors to detect symptoms of illness in a building or area occupant, to identify building or area occupants who may have come into contact with an ill occupant and/or to establish or monitor hygiene protocols.

The one or more sensors 26, 36, 66, L1-L10, and F1-F6 may be any one of a temperature sensor, a humidity sensor, an occupancy sensor, a pressure sensor, a flow sensor, a light sensor, a sound sensor (e.g. microphone), a video camera, a current sensor, a smoke sensor, and/or any other suitable sensor. In one example, at least one of the sensors 26, 36, 66, or other sensors, may be an occupancy sensor. The building control devices 22, 32, 42, 62 and/or the host device 70 may receive a signal from the occupancy sensor indicative of occupancy within a room or zone of the building or structure 10. In response, the building control devices 22, 32, 42, and/or 62 may send a command to activate one or more building control component(s) located in or servicing the room or zone where occupancy is sensed.

Likewise, in some cases, at least one of the sensors 26 may be a temperature sensor configured to send a signal indicative of the current temperature in a room or zone of the building or structure 10. The building control device 22 may receive the signal indicative of the current temperature from a temperature sensor 26. In response, the building control device 22 may send a command to an HVAC device 24 to activate and/or deactivate the HVAC device 24 that is in or is servicing that room or zone to regulate the temperature in accordance with a desired temperature set point.

In yet another example, one or more of the sensors may be a current sensor. The current sensor may be coupled to the one or more building control components and/or an electrical circuit providing electrical power to one or more building control components. The current sensors may be configured to send a signal to a corresponding building control device, which indicates an increase or decrease in electrical current associated with the operation of the building control component. This signal may be used to provide confirmation that a command transmitted by a building control device has been successfully received and acted upon by the building control component(s). These are just a few examples of the configuration of the BMS 12 and the communication that can take place between the sensors and the control devices.

In some cases, data received from the BMS 12 may be analyzed and used to dynamically (e.g., automatically) trigger or provide recommendations for service requests, work orders, changes in operating parameters (e.g., set points, schedules, etc.) for the various devices 24, 34, 64, L1-L10, F1-F6 and/or sensors 26, 36, 66 in the BMS 12. In some cases, data received from the BMS 12 may be analyzed and used to dynamically (e.g., automatically) trigger or provide information regarding the health status of occupants of the building or area. In yet other cases, data received from the BMS 12 may be analyzed and used to dynamically (e.g., automatically) trigger or provide information regarding noise levels or incidents generating noise in the building or area. It is contemplated that data may be received from the control devices 22, 32, 42, 62, devices 24, 34, 64, L1-L10, F1-F6, and/or sensors 26, 36, 66, as desired. In some cases, the data received from the BMS 12 may be combined with video data from image capturing devices. It is contemplated that the video data may be obtained from certain sensors 26, 36, 66 that are image capturing devices associated with discrete systems 20, 30, 60 of the BMS 12 or may be provided as separate image capturing devices such as video (or still-image) capturing cameras 80*a*, 80*b* (collectively 80), as desired. An "image" may include a still single frame image or a stream of images captured at a number of frames per second (e.g., video). While the illustrative building 10 is shown as including two cameras 80, it is contemplated that the building may include fewer than two or more than two cameras, as desired. It is further contemplated that the cameras (either discrete cameras 80 or cameras associated with a discrete system 20, 30, 60) may be considered to be "smart" cameras (which may be an internet of things (IoT) device) which are capable of independently processing the image stream or "non-smart" cameras which are used as sensors to collect video information which is analyzed by an independent video analytics engine. Some illustrative "non-smart" cameras may include, but are not limited to, drones or thermovision (e.g. IR) cameras.

It is contemplated that data from the BMS 12 and/or the sensors 26, 36, 66, 80 may be systematically analyzing and compared to baseline data from the BMS 12 to monitor activities from the individuals in different rooms/spaces within a building or building complex by recognizing their unique acoustic signatures. For example, if the acoustic signatures are representative of a lot of coughing and sneezing in a certain work area during normal work hours and observes a high usage of the restrooms nearby, a "health/wellbeing monitor" may generate a spike on its operating curve. By analyzing the historical data from a baseline model, the system can generate a "heath alert". Similarly, if a work space is relatively quiet during normal business hours and then the sound level from the human speech detected is increasing significantly over a period of time, a "workplace disturbance monitor" may be triggered, indicating a potential workplace dispute between the occupants at a certain location in the building.

Figure 2:
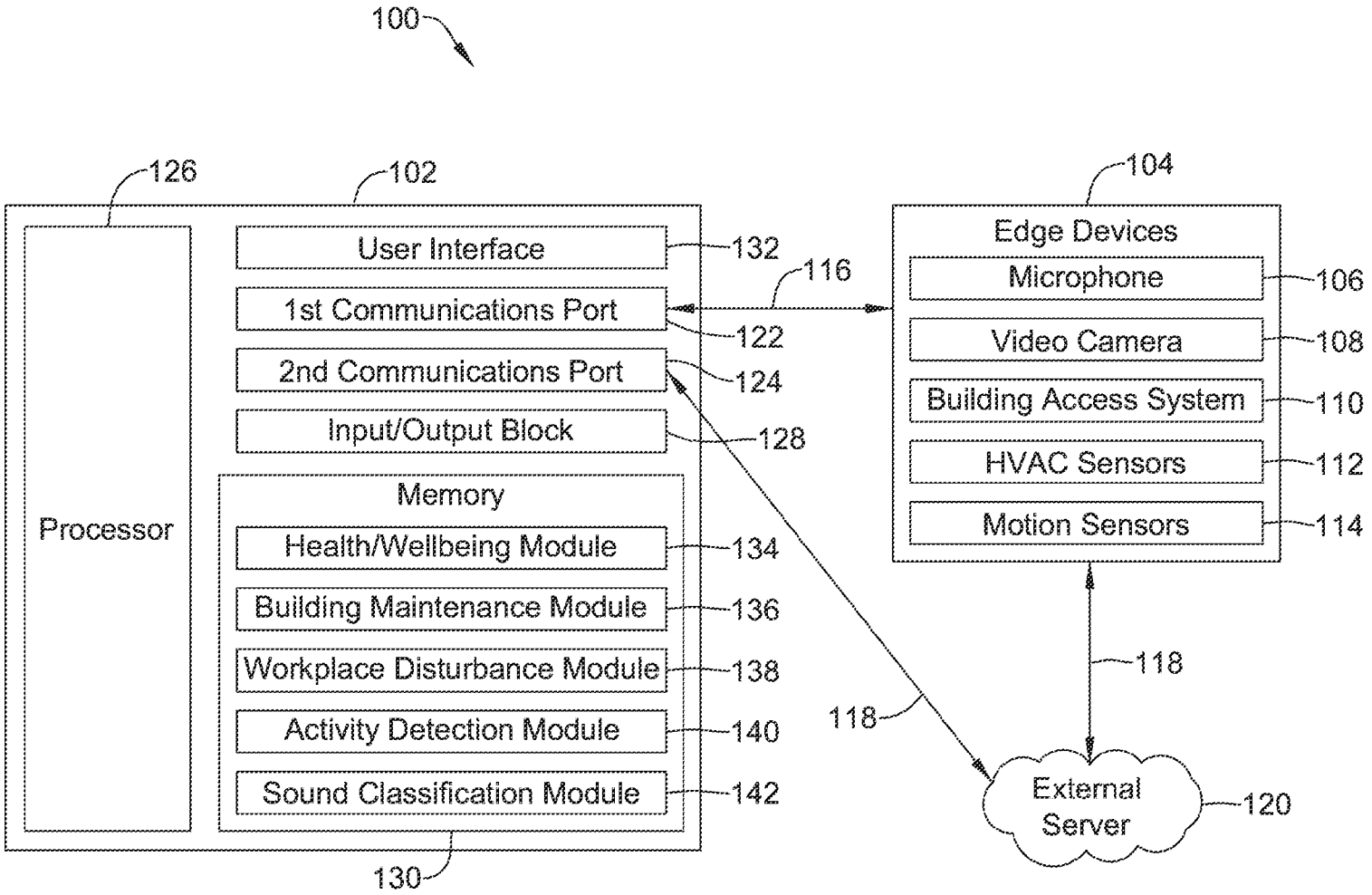
FIG. 2 is a block diagram of an illustrative automated sound profiling system.

FIG. 2 is a schematic block diagram of an illustrative automated sound profiling system 100 for monitoring or tracking human activity in a building. The system 100 may form a part of or be used in combination with any of the BMS systems 20, 30, 40, 50, 60 described above. For example, the system 100 may be in communication with any of the BMS systems 20, 30, 40, 50, 60 such that sound profiles are correlated to operating cycles of the BMS systems 20, 30, 40, 50, 60. In other examples, the system 100 may be a stand-alone system. It is further contemplated that the system 100 may be used in areas outside of a traditional building, such as, but not limited to, public transit or other areas where people may gather. In some cases, the system 100 can control one or more of an HVAC system, a security system, a lighting system, a fire system, a building access system and/or any other suitable building control system as desired.

In some cases, the system 100 includes a controller 102 and one or more edge devices 104. The edge devices 104 may include, but are not limited to, microphones (or other sound sensors) 106, still or video cameras 108, building access system readers or devices 110, HVAC sensors 112, motion sensors 114, and/or any of the devices or sensors described herein. The controller 102 may be configured to receive data from the edge devices 104, analyze the data, and make decisions based on the data, as will be described in more detail herein. For example, the controller 102 may include control circuitry and logic configured to operate, control, command, etc. the various components (not explicitly shown) of the system 100 and/or issue alerts or notifications.

The controller 102 may be in communication with any number of edge devices 104 as desired, such as, but not limited to, one, two, three, four, or more. In some cases, there may be more than one controller 102, each in communication with a number of edge devices. It is contemplated that the number of edge devices 104 may be dependent on the size and/or function of the system 100. The edge devices 104 may be selected and configured to monitor differing aspects of the building and/or area of the system 100. For example, some of the edge devices 104 may be located interior of the building. In some cases, some of the edge devices 104 may be located exterior to the building. Some of the edge devices 104 may be positioned in an open area, such as a park or public transit stop. These are just some examples.

The controller 102 may be configured to communicate with the edge devices 104 over a first network 116, including a local area network (LAN) or a wide area network (WAN), or the connection may be made to an external computer (for example, through the Internet using an Internet Service Provider). Such communication can occur via a first communications port 122 at the controller 102 and a communication interface (not explicitly shown) at the edge devices 104. The first communications port 122 of the controller 102 and/or the communication interfaces of the edge devices 104 can be a wireless communications port including a wireless transceiver for wirelessly sending and/or receiving signals over a wireless network 116. However, this is not required. In some cases, the first network 116 may be a wired network or combinations of a wired and a wireless network.

The controller 102 may include a second communications port 124 which may be a wireless communications port including a wireless transceiver for sending and/or receiving signals over a second wireless network 118. However, this is not required. In some cases, the second network 118 may be a wired network or combinations of a wired and a wireless network. In some embodiments, the second communications port 124 may be in communication with a wired or wireless router or gateway for connecting to the second network 118, but this is not required. When so provided, the router or gateway may be integral to (e.g., within) the controller 102 or may be provided as a separate device. The second network 118 may be a wide area network or global network (WAN) including, for example, the Internet. The controller 102 may communicate over the second network 118 with an external web service hosted by one or more external web servers 120 (e.g. the cloud).

The controller 102 may include a processor 126 (e.g., microprocessor, microcontroller, etc.) and a memory 130. In some cases, the controller 102 may include a user interface 132 including a display and a means for receiving user input (e.g., touch screens, buttons, keyboards, etc.). The memory 130 may be in communication with the processor 126. The memory 130 may be used to store any desired information such as, but not limited to, control algorithms, configuration protocols, set points, schedule times, diagnostic limits such as, for example, differential pressure limits, delta T limits, security system arming modes, and the like. In some embodiments, the memory 130 may include specific control programs or modules configured to analyze data obtained from the edge devices 104 for a particular condition or situation. For example, the memory 130 may include, but is not limited to, a health and/or wellbeing module 134, a building maintenance module 136, a workplace disturbance module 138, an activity detection module 140, and/or a sound classification module 142. Each of these sound classification modules 134, 136, 138, 140, 142 may be configured to detect sounds and/or activity that are attributable to humans within the monitored space, as will be described in more detail herein. The memory 130 may include one or more of the sound classification modules 134, 136, 138, 140, 142. In some cases, the memory 130 may include additional sound classification modules beyond those specifically listed. The memory 130 may be any suitable type of storage device including, but not limited to, RAM, ROM, EPROM, flash memory, a hard drive, and/or the like. In some cases, the processor 126 may store information within the memory 130, and may subsequently retrieve the stored information from the memory 130.

In some embodiments, the controller 102 may include an input/output block (I/O block) 128 having a number of wire terminals for receiving one or more signals from the edge devices 104 and/or system components and/or for providing one or more control signals to the edge devices 104 and/or system components. For example, the I/O block 128 may communicate with one or more components of the system 100, including, but not limited to, the edge devices 104. The controller 102 may have any number of wire terminals for accepting a connection from one or more components of the system 100. However, how many wire terminals are utilized and which terminals are wired is dependent upon the particular configuration of the system 100. Different systems 100 having different components and/or types of components may have different wiring configurations. In some cases, the I/O block 128 may be configured to receive wireless signals from the edge devices 104 and/or one or more components or sensors (not explicitly shown). Alternatively, or in addition to, the I/O block 128 may communicate with another controller. It is further contemplated that the I/O block 128 may communicate with another controller which controls a separate building control system, such as, but not limited to a security system base module, an HVAC controller, etc.

In some cases, a power-transformation block (not explicitly shown) may be connected to one or more wires of the I/O block 128, and may be configured to bleed or steal energy from the one or more wires of the I/O block 128. The power bled off of the one or more wires of the I/O block may be stored in an energy storage device (not explicitly shown) that may be used to at least partially power the controller 102. In some cases, the energy storage device may be capacitor or a rechargeable battery. In addition, the controller 102 may also include a back-up source of energy such as, for example, a battery that may be used to supplement power supplied to the controller 102 when the amount of available power stored by the energy storage device is less than optimal or is insufficient to power certain applications. Certain applications or functions performed by the base module may require a greater amount of energy than others. If there is an insufficient amount of energy stored in the energy storage device then, in some cases, certain applications and/or functions may be prohibited by the processor 126.

The controller 102 may also include one or more sensors such as, but not limited to, a temperature sensor, a humidity sensor, an occupancy sensor, a proximity sensor, and/or the like. In some cases, the controller 102 may include an internal temperature sensor, but this is not required.

The user interface 132, when provided, may be any suitable user interface 132 that permits the controller 102 to display and/or solicit information, as well as accept one or more user interactions with the controller 102. For example, the user interface 132 may permit a user to locally enter data such as control set points, starting times, ending times, schedule times, diagnostic limits, responses to alerts, associate sensors to alarming modes, and the like. In one example, the user interface 132 may be a physical user interface that is accessible at the controller 102, and may include a display and/or a distinct keypad. The display may be any suitable display. In some instances, a display may include or may be a liquid crystal display (LCD), and in some cases an e-ink display, fixed segment display, or a dot matrix LCD display. In other cases, the user interface may be a touch screen LCD panel that functions as both display and keypad. The touch screen LCD panel may be adapted to solicit values for a number of operating parameters and/or to receive such values, but this is not required. In still other cases, the user interface 132 may be a dynamic graphical user interface.

In some instances, the user interface 132 need not be physically accessible to a user at the controller 102. Instead, the user interface may be a virtual user interface 132 that is accessible via the first network 116 and/or second network 118 using a mobile wireless device such as a smart phone, tablet, e-reader, laptop computer, personal computer, key fob, or the like. In some cases, the virtual user interface 132 may be provided by an app or apps executed by a user's remote device for the purposes of remotely interacting with the controller 102. Through the virtual user interface 132 provided by the app on the user's remote device, the user may change control set points, starting times, ending times, schedule times, diagnostic limits, respond to alerts, update their user profile, view energy usage data, arm or disarm the security system, configured the alarm system, and/or the like.

In some instances, changes made to the controller 102 via a user interface 132 provided by an app on the user's remote device may be first transmitted to an external web server 120. The external web server 120 may receive and accept the user inputs entered via the virtual user interface 132 provided by the app on the user's remote device, and associate the user inputs with a user's account on the external web service. If the user inputs include any changes to the existing control algorithm including any temperature set point changes, humidity set point changes, schedule changes, start and end time changes, window frost protection setting changes, operating mode changes, and/or changes to a user's profile, the external web server 120 may update the control algorithm, as applicable, and transmit at least a portion of the updated control algorithm over the second network 118 to the controller 102 where it is received via the second port 124 and may be stored in the memory 130 for execution by the processor 126. In some cases, the user may observe the effect of their inputs at the controller 102.

Rather than a dedicated app, the virtual user interface 132 may include one or more web pages that are transmitted over the second network 118 (e.g. WAN or the Internet) by an external web server (e.g., web server 120). The one or more web pages forming the virtual user interface 132 may be hosted by an external web service and associated with a user account having one or more user profiles. The external web server 120 may receive and accept user inputs entered via the virtual user interface 132 and associate the user inputs with a user's account on the external web service. If the user inputs include changes to the existing control algorithm including any control set point changes, schedule changes, start and end time changes, window frost protection setting changes, operating mode changes, and/or changes to a user's profile, the external web server 120 may update the control algorithm, as applicable, and transmit at least a portion of the updated control algorithm over the second network 118 to the controller 102 where it is received via the second port 124 and may be stored in the memory 130 for execution by the processor 126. In some cases, the user may observe the effect of their inputs at the controller 102.

In some cases, a user may use either a user interface 132 provided at the controller 102 and/or a virtual user interface as described herein. These two types of user interfaces are not mutually exclusive of one another. In some cases, a virtual user interface 132 may provide more advanced capabilities to the user. It is further contemplated that a same virtual user interface 132 may be used for multiple BMS components.

It is contemplated that identifying and/or tracking human activities may provide information to a building manager that may be used to improve a working environment, reduce a spread of illness, resolve employee conflicts and/or respond to an incident, among others. While the edge devices 104 may be used to generate a "heat map" of the sound environments (e.g., a map indicating overall noise levels) in each room or area of a building, the sound map may not give an indication of noise levels that are attributable to human activity. For example, in buildings or building complexes there are often noises occurring that are not attributable to human activity. These noises may include, but are not limited to, HVAC equipment and/or other equipment associated with the various building management systems. The system 100 for tracking human activity may be deployed in two stages: a calibration stage or mode to determine and/or collect sound profiles for each room or space (sometimes with the HVAC and/or other BMS equipment in various modes or cycles) in the absence of humans, and an operational stage or mode to collect and analyze audio in the presence of humans or when humans are expected or could be present. Sound profiles may be collected for each room or space where it is desired to monitor or track human activity.

Figure 3:
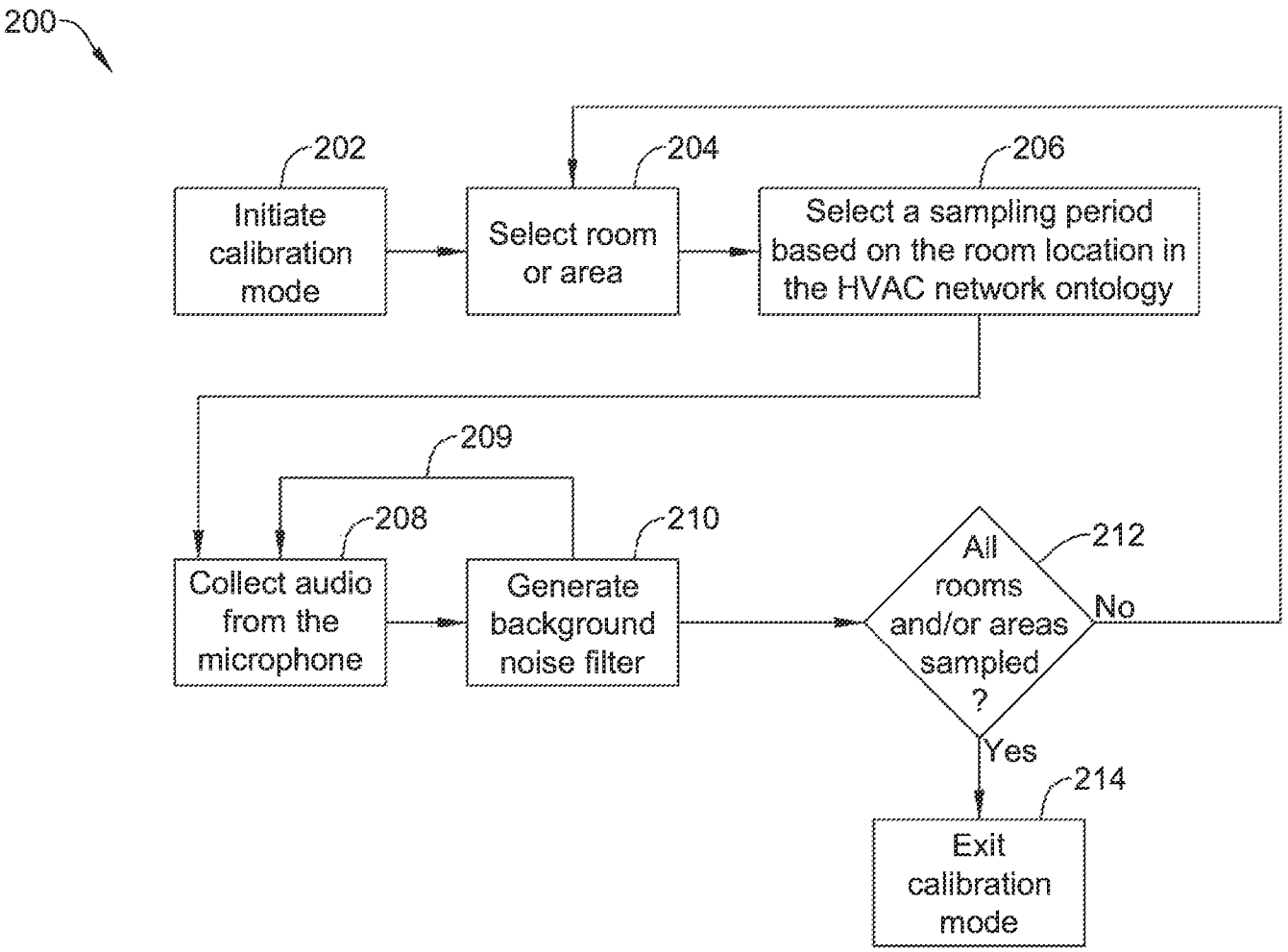
FIG. 3 is a flow chart of an illustrative method for capturing one or more sound profiles for a given room or space and to generate one or more background noise filters for the room or space.

FIG. 3 is a flow chart of an illustrative method 200 for capturing one or more sound profiles for a given room or space and generating one or more background noise filters for the room or space. Generally, these sound profiles may be used to train the controller 102 to learn and recognize background sound from the HVAC system and/or other building systems without the presence of humans in the room. These sound profiles may be used to generate one or more background noise filters for each room or space, which may then be used to differentiate between sounds attributable to the building systems and sounds attributable to human activity. It should be understood that sound profiles may be captured for each room or area where it is desired to monitor human activity.

To begin, a calibration mode may be initiated at the controller 102, as shown at block 202. It is contemplated that the calibration mode may be initiated in response to a user input or command (e.g., received via the user interface) or may occur automatically at a commissioning of either or both of the system 100 or the BMS 12. In some cases, the calibration mode may be initiated on a scheduled basis, such as weekly, during a time when no human activity is expected to be present, so that the background noise filters are continually updated to adapt to changing conditions.

In some cases, the calibration may be performed by a dedicated automated sound profiling system that is connected to the microphones 106 of the BMS 12 which may include a dedicated controller and/or logic, although this is not required. The calibration may be performed offline at a particular building site. However, this is not required. It is contemplated that the calibration may be initiated remotely, if so desired. The data generated during calibration may be stored and/or processed locally on-site and/or at a remote server 120.

Once in the calibration mode, a room or area may be selected for which a sound profile is to be obtained, as shown at block 204. As used herein, the sound profile is a baseline noise profile for the sounds that occur in the absence of humans. It is contemplated that a room or area may have more than one sound profile. For example, a location of the HVAC equipment relative to the room or space, HVAC equipment operating cycles, a type of the room or area, a location of the room or area, a schedule of the room (e.g., for a conference room), lighting schedules, etc. may all be taken into consideration when determining the number of sound profiles for a given room or space. It is contemplated that the HVAC system (and/or other BMS components) may enter and exit different operational cycles or workloads at different times during a day and/or different days of the week (e.g., a weekday versus a weekend). For example, one or more of the HVAC components (and/or other BMS components) may have multiple operating cycles, modes, or workloads depending on the current needs of the building. It is further contemplated that the transition between workloads may not be abrupt but rather may include a transition.

Figure 4:
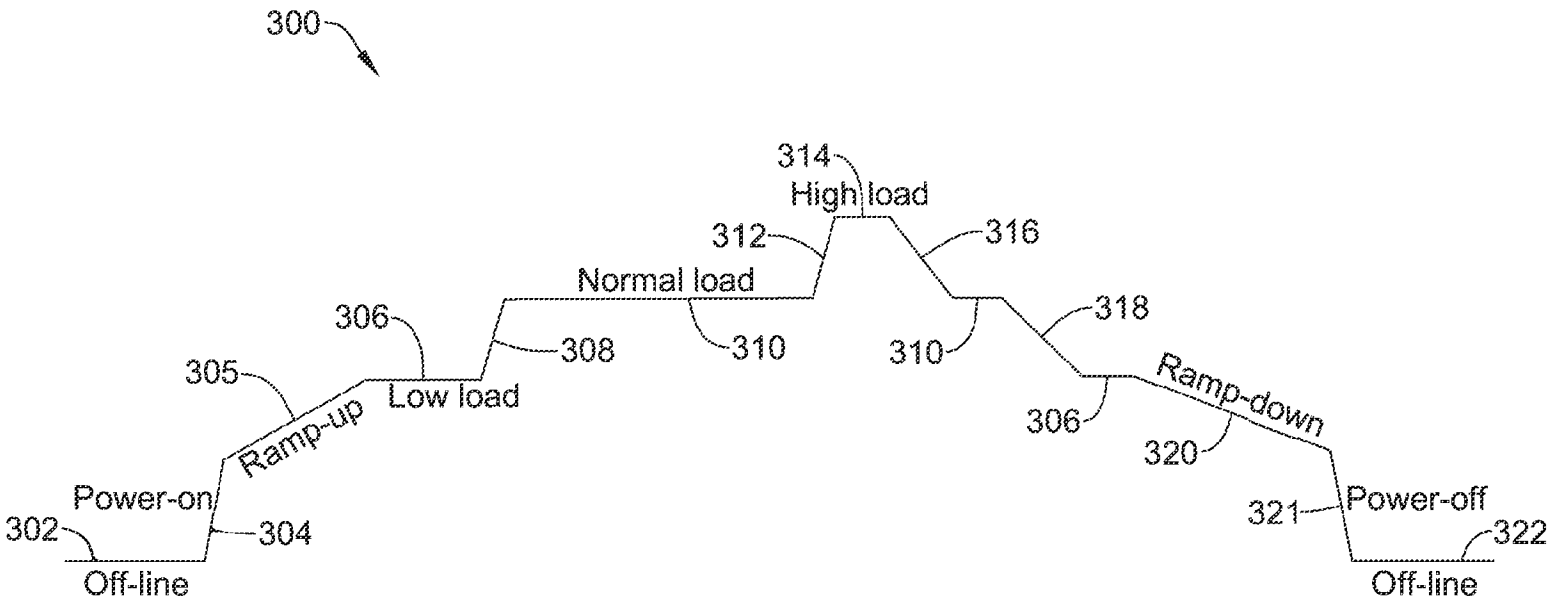
FIG. 4 is an illustrative time line of an operating cycle of a chiller.

Referring briefly to FIG. 4, which illustrates an operating cycle 300 of a chiller, it is shown that a single HVAC device may experience a variety of different operating modes or cycles. While FIG. 4 shows one illustrative operating cycle 300, other operating cycles having varying loads, ramp up time, ramp down times, etc. are also contemplated. When the chiller is not in use, it is off-line 302. When the HVAC system 20 calls for cool air, the chiller is powered on and begins a sharp increase in load 304. The chiller load may continue to increase 305 at slower pace until a predetermined load point 306 is obtained. In the illustrated example, this is considered to be a "low" load. The chiller may be maintained at the "low" load 306 for a period of time before entering another ramp up period 308 which is terminated when a second predetermined load point 310 is obtained. In the illustrated example, this is considered to be a "normal" load. The chiller may be maintained at the "normal" load 310 for a period of time before entering another ramp up period 312, which terminates when a third predetermined load point 314 is obtained. In the illustrated example, this is considered to be a "high" load. The chiller may be maintained at the "high" load 314 for a period of time before entering a ramp down period 316 which terminates when the second predetermined load point 310 is obtained. The "normal" load 310 is maintained for a period of time before entering another ramp down period 318, which terminated when the first predetermined load point 306 is obtained. The "low" load 306 is maintained for a period of time before entering another ramp own period 320, which is terminates when the chiller is powered off. Turning off the chiller may result in sharp decrease in load 321, until there is zero load 322. The chiller may generate sounds with very different amplitude and frequency characteristics depending on the particular part of the cycle the chiller is currently operating.

Returning to FIG. 3, once the room or area has been selected, a sampling period may be selected, as shown at block 206. The sampling period may be selected based, at least in part, on the room location in the network ontology. For example, when rooms or areas are located in close proximity to one or more components of an HVAC system (or other BMS component), the cycles of the equipment may have a greater impact on the acoustics of the room or area. It is contemplated that sampling period may be user defined or may be determined by an algorithm stored in the memory 130 of the controller 102, as desired. The sampling period may specify a period of time over which to collect the samples. The period of time may include different parts of the day (e.g., early morning, morning, lunch, afternoon, evening, night) and different days of the week (e.g., weekday and weekend). The sampling period may be selected to capture the HVAC system (and/or other BMS components) in different operational loads or cycles. In some cases, the sampling period may be selected such that one or more room sound profiles are based at least in part on background audio captured in the room during each of a plurality of time periods over at least a 24-hour time period. It is further contemplated that the one or more room sound profiles are based at least in part on background audio captured in the room during each of a plurality of time periods over a plurality of days.

Once the sampling period has been selected, the controller 102 may then collect audio from one or more microphones and/or other sound sensors (e.g. accelerometers, etc.) 106 located in the selected room or area, as shown at block 208. In some cases, audio may be collected over a predetermined time period or at predetermined intervals over a selected sampling period. In one example, audio may be collected for a predetermined time period of 30 seconds every five minutes during the selected sampling period. This is just one example. It is contemplated that the time period, interval of collection and/or sampling period may vary depending on the proximity of the room or area to a known source of noise (e.g., piece of HVAC equipment), an operating mode of the source of noise, and/or other conditions. In one example, the closer the room or area is to the source of the noise, the more audio may be required to generate the sound profiles for the room or area. It is contemplated that the time period may be increased, intervals shortened and/or the sampling period increased to obtain sufficient audio for a room or area. As the room or area increases in distance from the source(s) of the noise, the time period may be decreased, intervals increased, and/or the sampling period reduced to obtain sufficient audio for the room or area. The audio may be stored as one or more room sound profiles in the memory 130 of the controller 102 along with information (e.g., metadata) about the operational cycle of the HVAC system (or other BMS component) which may include but is not limited to a component name, a cycle of said component (e.g., low, normal, high), a day of the week, a time of the day, a season, etc. In some cases, the one or more room sound profiles are correlated to one or more operating cycles of one or more components of a Heating, Ventilation, and/or Air Conditioning (HVAC) system.

After the audio is collected, one or more background noise filters may be generated based on one or more of the room sound profiles, as shown at block 210. In some cases, a background noise filter may be generated after each predetermined time period in an iterative manner, as indicated by arrow 209. However, this is not required. In some cases, the background noise filters may be generated after all of the audio has been collected. The background noise filters may be stored in the memory 130 of the controller 102 for use by the sound classification modules 134, 136, 138, 140, 142. The background noise filters may be stored with metadata including information about the operating cycles and/or modes of the HVAC system (or other BMS components) which each particular background noise filter was generated. The background noise filters are configured to remove expected noises produced by one or more components of an HVAC or building management system from the real time audio (as described in more detail herein). As room sound profiles are collected for a plurality of operational cycles of one or more components of a building management system, the background noise filters may include a background noise filter for each of two or more operational cycles of one or more components of a building management system.

The system 100 may then determine if all rooms and/or areas have been sampled and respective background noise filters generated, as shown at block 212. If all of the rooms and/or areas have not been sampled, the controller 102 or user may select the next room or area for which background noise filters are to be generated, as shown at block 204. The room selection 204, sample period selection 206, audio collection 208, and background noise filter generation 210 steps may be repeated as many times as necessary until all rooms or areas for which monitoring is desired have associated background noise filters.

In some cases, data may be collected from and background noise filters generated for more than one room or area simultaneously (e.g., in parallel). In other cases, data may be collected from and background noise filters generated for each room or area individually (e.g., sequentially). Once it is determined that all rooms and/or areas have been sampled and respective background noise filters generated, the controller 102 may exit the calibration mode, as shown at block 214. This may be done in response to a user input received at the user interface or automatically, as desired. While the calibration mode is described as executed in the absence of human activity, in some cases, additional calibrations may be performed to generate additional data with respect to sound under normal occupancy conditions with what is considered to be normal human activity for that room or space.

Figure 5:
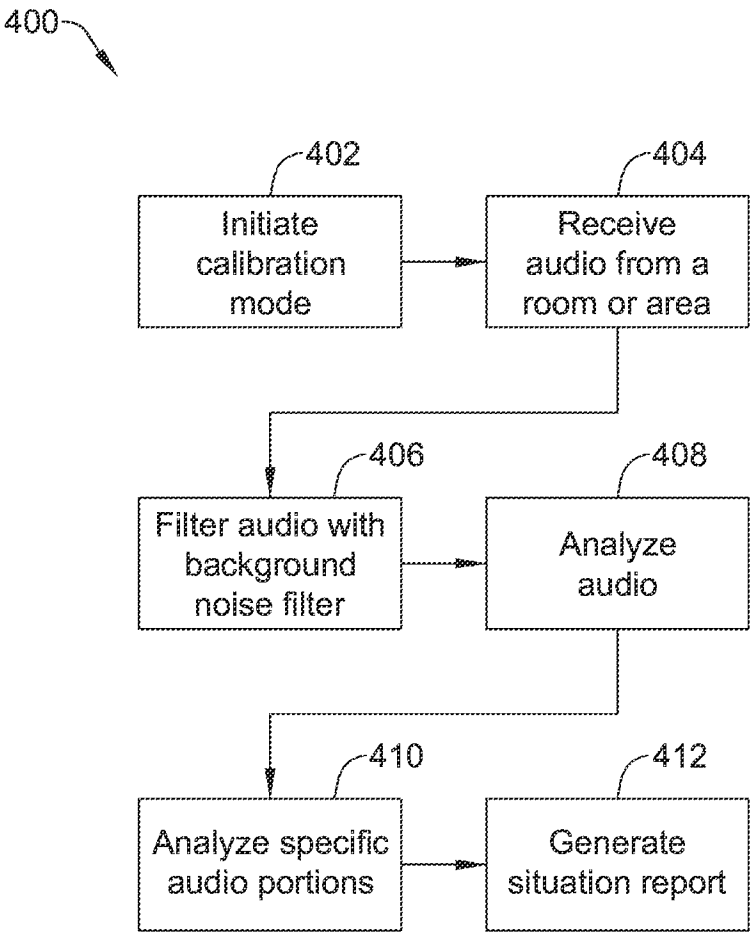
FIG. 5 is a flow chart of an illustrative method for tracking or monitoring human activity in a room or area.

FIG. 5 is a flow chart of an illustrative method 400 for tracking or monitoring human activity in a room or area. After the calibration is complete, such as described above with respect to FIG. 3, the system 100 may be placed into an operational mode, as shown at block 402. Once in the operational mode, the sound profiling system 100 collects audio from a room or area, as shown at block 404. It is contemplated that the sound profiling system 100 may be receiving audio from more than one room simultaneously. In some cases, the audio may be received in real time while in other cases, audio recordings may be transmitted at predefined time intervals. In some cases, the audio may be pre-processed at the microphone or sensor 106 prior to transmitting the audio to the controller 102. For example, the in room (or area) audio sensors 106 may process the audio and generate feature vectors in real time which retain acoustic signatures unique to the relevant sounds. Some illustrative feature vectors may include, but are not limited to, zero crossing, signal energy, energy-entropy, spectrum centroid, spectrum spread, spectrum entropy, spectrum roll-off, and/or Mel-frequency cepstral coefficients (MFCC). In some cases, there may be in the range of 24 to 39 MFCC depending on accuracy and model size. In one example, and depending on the size of MFCC vectors, the total number of base features extracted from the audio signals can be as high as 42 (7 (zero crossing, signal energy, energy-entropy, spectrum centroid, spectrum spread, spectrum entropy, spectrum roll-off)+39 (MFCC)). In this example, if deltas are added for MFCC (difference between two consecutive time intervals), the enhanced feature set can have as few as 55 (7+24+24) or as high as 85 (7+39+39) features. The feature vectors may be extracted from a slice of audio signal known as frames, which can have a duration between 30 to 45 milliseconds. The controller 102 may then perform the analyzed on the vector data. In such an instance, the controller does not retain the original audio content nor can it be recreated from the feature vectors. This may help protect occupant privacy.

Figure 6A:
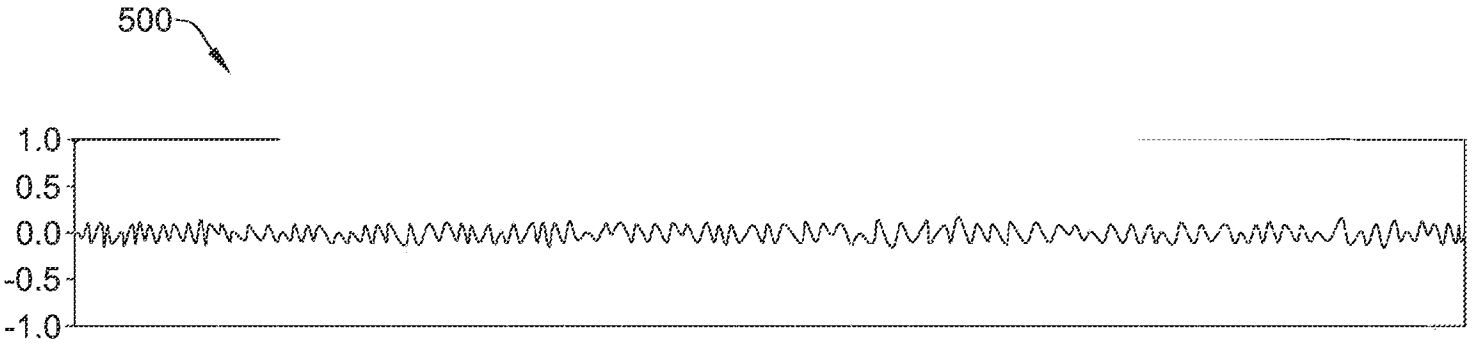
FIG. 6A illustrates a waveform of an original audio recording.
Figure 6B:
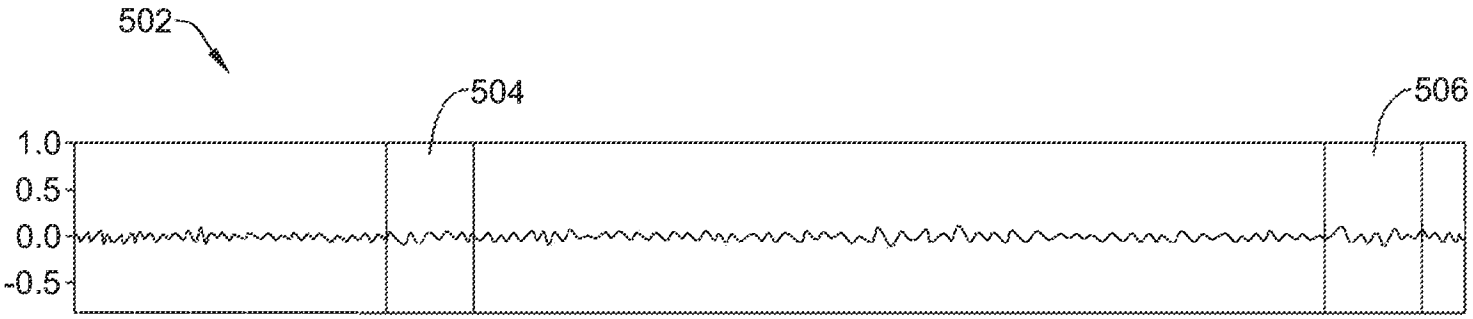
FIG. 6B illustrates a waveform of the audio recording of FIG. 6A after filtering with a custom background noise filter generated using the illustrative method of FIG. 3.

As the audio is received, the controller 102 may filter the audio with a background noise filter to remove sounds that may be attributable to the HVAC system or other BMS equipment. The sound profiling system 100 may be configured to perform premise-based processing of the audio (i.e. performed on-premises). In other cases, the analysis may be cloud based (i.e. performed in the cloud). The controller 102 may select a background noise filter that was generated for the room or area from which the audio was received. Further, the controller 102 may also select a background noise filter that was generated under similar HVAC system (or other BMS equipment) operating conditions. FIG. 6A illustrates a waveform of an original audio recording 500 and FIG. 6B illustrates a waveform 502 of the audio recording 500 after filtering with the custom background noise filter for that space. As can be seen, the filtered waveform 502 has less audio activity, since the background audio has been largely filtered out.

Returning to FIG. 5, the system 100 may then analyze the filtered audio to determine what types of sounds attributable to human activity are present, if any, as shown at block 406. Some illustrative sounds associated with human activity may include, but are not limited to, talking, yelling, sneezing, coughing, running water, keyboard clicking, operation of cleaning equipment, gunshot-like sounds, etc. The system 100 may analyze the filtered audio by comparing the filtered audio to one or more sound classification models stored in the sound classification module 142. The sound classification module 142 may be trained to recognize sounds associated with certain human activity. For example, the sound classification module 142 may include one or more human voice models, an illness detection module, a human activity model one or more tap (or running) water models, one or more laughter models, one or more coughing/sneezing models, one or more vacuum sound models, etc. In some cases, the models within the sound classification module 142 may be continually updated or refined using machine learning techniques.

Figure 7B:
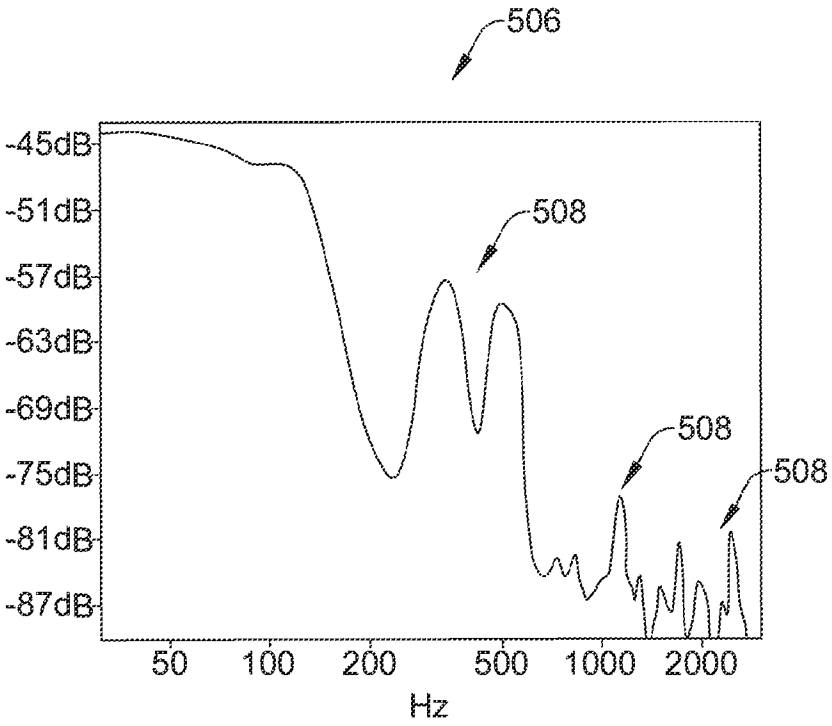
FIG. 7B illustrates a second slice of the filtered waveform of FIG. 6B.
Figure 7A:
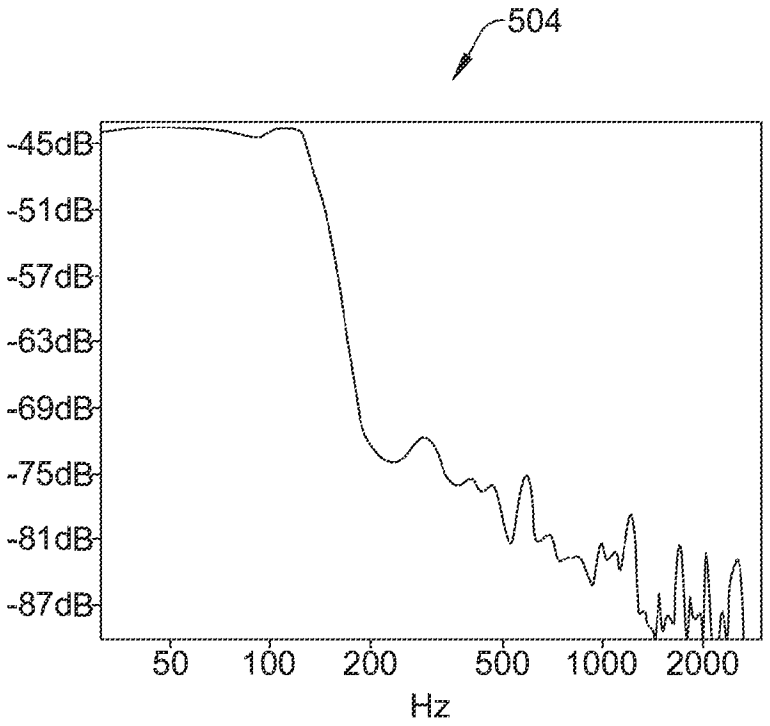
FIG. 7A illustrates a first slice of the filtered waveform of FIG. 6B.

To analyze the audio, the controller 102 may analyze the frequency and/or volume of the filtered audio to determine if there are any sounds associated within human activity. This may be performed by comparing the filtered audio to one or more of the models in the sound classification module. FIG. 7A illustrates a first slice 504 of the filtered waveform 502 of FIG. 6B. The first slice 504 indicates the room from which the audio was collected has no audible human speech as indicated by the spectrograph in the frequency generally associated with human speech (e.g., about 200 Hertz (Hz) to 4,000 Hz). FIG. 7B illustrates a second slice 506 of the filtered waveform 502 of FIG. 6B. In the second slice 504 human speech is detected as indicated by the prominent spectral peaks 508 in the frequency bands that are commonly associated with the vocal sounds produced by people. While FIGS. 7A and 7B are described with reference to human speech or vocal sounds, it should be understood that the controller 102 is analyzing the waveforms for other sounds associated with human activity including, but not limited to, laughter, coughing, sneezing, running water, cleaning equipment, etc.

In addition to recognizing a type of sound, the controller 102 may be configured to estimate a number of people that are in a room or area. It is further contemplated that the controller 102 may be able to locate the source of a particular sound. For example, since the audio sensors 106 are fixed to a specific location within a room or a space, when the number of audio sensors 106 installed in one room or one space is equal or greater three, a triangular (or multiple virtual triangles) formed by three adjacent audio sensors 106 may provide the coordinate audio streams to the controller 102. The software stored and executed on the controller 102 may not only identify the human activity related sounds in the room but also provide a source location of those audio sounds of interests using triangulation. In some cases, the controller 102 may detect a sound which cannot be correlated to a sound in the sound classification module 142. In such an instance, the controller 102 may flag the sound based on the location and/or noise level. An alert or notification for follow up by a human operator may be generated.

Returning to FIG. 5, when sounds are detected that are associated with human activity, the portion of the audio including said sounds may be further analyzed, as indicated at block 410. For example, the controller 102 may be configured to determine when one or more of the sounds associated with human activity are abnormal. Abnormal sounds may include, but are not limited to, elevated voices (sometimes persisting over a predetermined length of time), increased levels of coughing and/or sneezing, increased lengths of time of running water (which may indicate an increase in hand washing), an unexpected occupancy number in the room. In some cases, an abnormal sound may be the absence of an expected sound. This may include the absence of the sounds of a vacuum during scheduled cleaning periods, the absence of human voices, etc. In some cases, a building or site may include private or custom sound models that are unique or specific to that particular building or site. It is further contemplated that the audio events of all matching sound events (whether or not they are considered abnormal) may be logged or stored for each room or area each day. These events may be used as a part of the BMS occupancy activity records. The normal patterns may be automatically generated and aggregated over each operating mode over time (e.g., low, normal high, weekday (Monday-Friday), weekend (Saturday-Sunday), seasons, etc. In some cases, the access control system 60 and/or wireless signals from occupants' mobile devices may be used to confirm or enhance the occupancy records.

The controller 102 may generate and transmit an alert when one or more sounds associated with human activity in the room is determined to be abnormal, as shown at block 412. These alerts may include, but are not limited to, a building occupant health alert, a workplace disturbance alert, a cleaning alert, and a gunshot-like sound alert, etc. It is contemplated that the alert may be sent to a remote or mobile device of a supervisor or other user. The notification may be a natural language message providing details about the abnormal sounds and/or a recommended action. In some cases, the alert may trigger an additional action to be taken by the BMS 12. For example, a workplace disturbance may result in the automatic locking of one or more doors. In another example, a health alert may result in an increase in the air turnover rate in the corresponding space. There are just some examples.

Alternatively, or additionally to an alert, the controller 102 may generate and transmit a building situation report to a user. The building situation report may be based at least in part on the identified sounds associated with human activity in the room or building. The building situation report may include all abnormal or documented audio events that occurred over a specified time period in a building or complex. The situation report may be transmitted (e.g., e-mailed, texted, etc.) to one or more supervising or other users. In some cases, the situation report may include a classification of the type of sound, an occupancy of a room or space, an expected occupancy of a room or space, a heat map representing human activity across one or more rooms in the building, a recommended action, etc.

Figure 8:
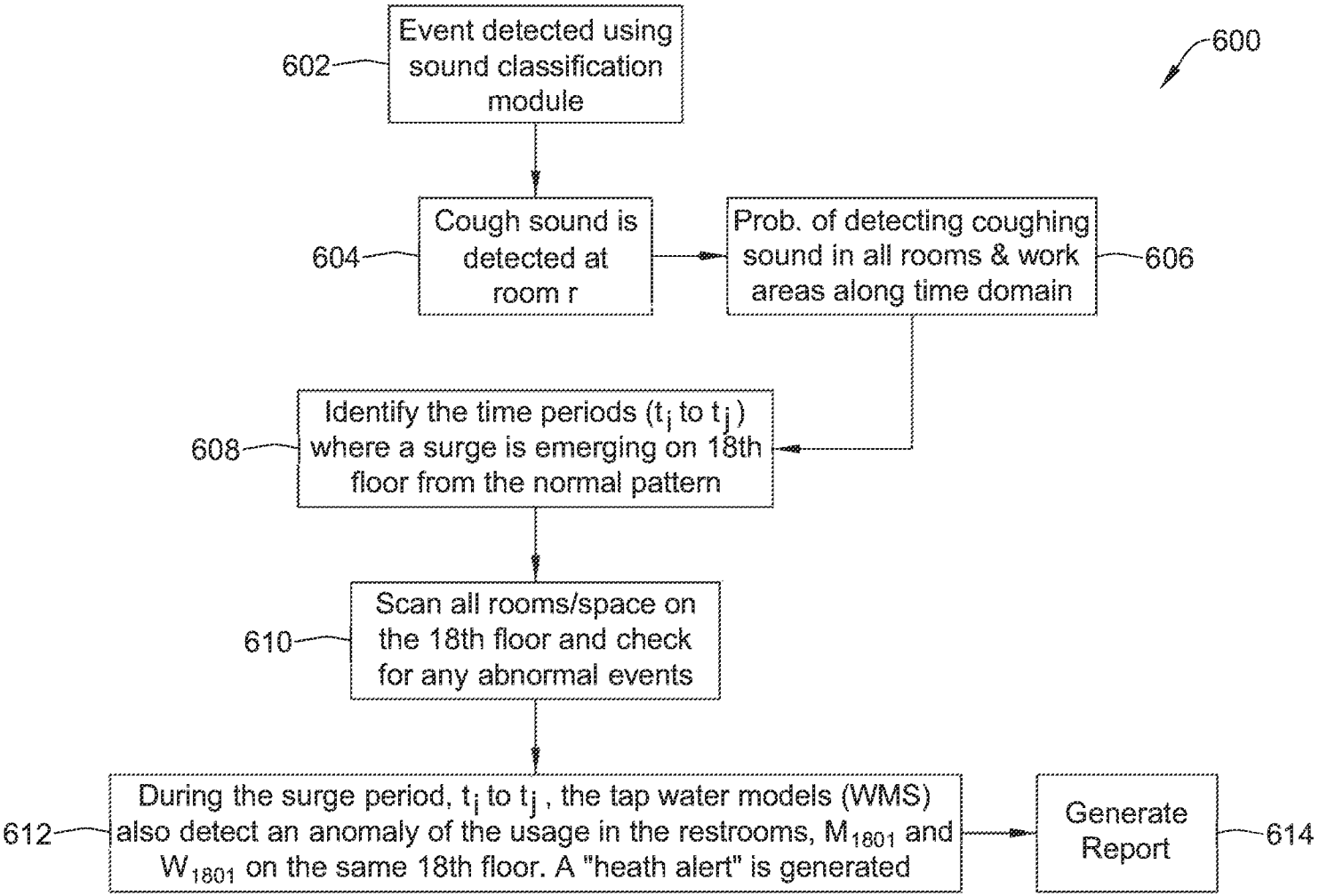
FIGS. 8-11 are flow charts of various illustrative methods for analyzing sound events detected in a room.

FIG. 8 is an illustrative flow chart 600 of an analysis of a sound event that may be detected using sound profiling system 100. To begin, a sound associated with human activity may be identified from filtered audio (e.g., blocks 406 and 408 in FIG. 5), as shown at block 602. More specifically the controller 102 may utilize the sound classification module to determine the sound is a cough which has originated in room R, as shown at block 604. In order to determine if the cough is a normal occurrence (e.g., someone clearly a throat, etc.) or should be considered an abnormal event, the controller 102 may analyze the previously obtained audio (for room R and/or other rooms or areas in the building) to determine a probably of a coughing sound occurring along a time domain, as shown at block 606. If it is determined that the volume, frequency and/or duration of the cough is a common occurrence or meets a predetermined probability, the controller 102 may take no further action.

If it is determined that the cough sound is not a common occurrence (e.g., is abnormal) or does not meet the predetermined probability, the controller 102 may identify the time period or time periods ($t_i$ to $t_j$) where a surge or difference from the normal pattern is emerging, as shown at block 608. In the illustrated example, this is shown as the $18^{th}$ floor of a building. In some cases, the controller 102 may then scan the audio transmissions from other rooms and spaces on the $18^{th}$ floor (e.g., locations near room R) to determine if any other abnormal events have occurred during a similar time period, as shown at block 610. In some cases, the controller 102 may scan other BMS components to determine if other unusual events have occurred. In the illustrated example, the controller 102 determines that during the cough surge period ($t_i$ to $t_j$) an anomaly was detected in the restrooms on the same floor, as shown at block 612. For example, there may be an increase in the running water which may indicate an increased restroom usage or an increase in hand washing. The controller 102 may generate a health alert in response to the detected cough and/or the increased water usage. It is contemplated that one or more additional abnormal events may be used to increase the confidence that the original abnormal event necessitates the generation of an alert. However, this is not required. In some cases, the originating event (e.g., the cough) may be sufficient for the controller 102 to generate and transmit a health alert.

It is contemplated that when abnormal coughing or other audible indications of poor health or illness (e.g., sneezing, hoarse voice, etc.) are detected, a health alert may be sent to one or more supervising or other users. The health alert may provide information about the abnormal event, how long it occurred, where it occurred, etc. The health alert may prompt the supervising user to investigate a cause of the abnormal event. In some cases, the event may be caused by an illness that has spread through occupants of the building. In such as instance, occupants may be sent home, areas disinfected, etc. In other cases, the event may be caused by poor air quality within the building or space. In such an instance, the HVAC system 20 settings may be adjusted, air filters changed, equipment serviced, etc. These are just some examples of some situations which may lead to the abnormal event. Additionally, or alternatively, the health alert may be provided within a building situation report, as shown at block 614. The building situation report may include all abnormal or documented audio events that occurred over a specified time period in a building or complex. The situation report may be transmitted (e.g., e-mailed, texted, etc.) to one or more supervising or other users.

Figure 9:
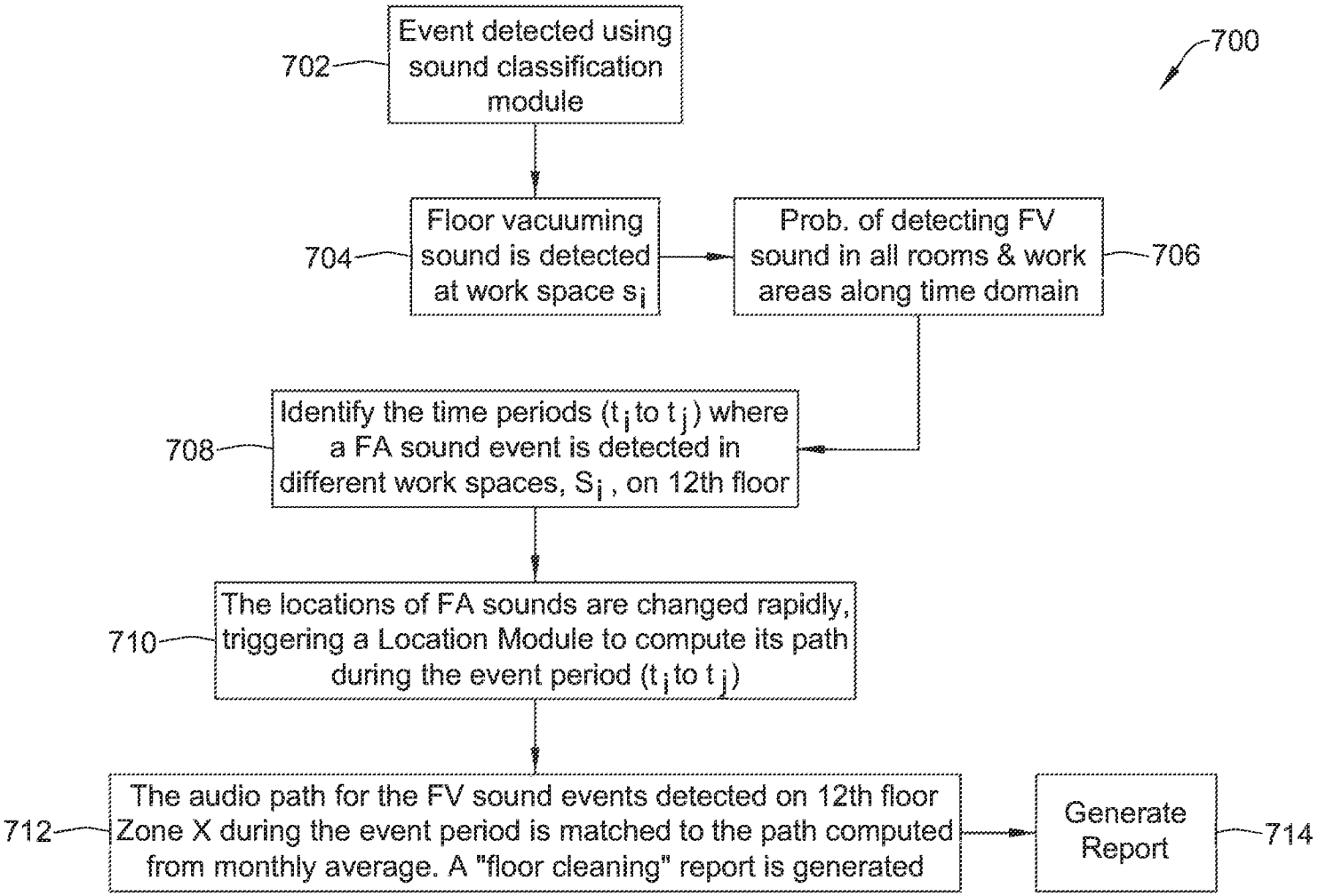

FIG. 9 is an illustrative flow chart 700 of an analysis of another illustrative sound event that may be detected using sound profiling system 100. To begin, a sound associated with human activity may be identified from filtered audio (e.g., steps 406 and 408 in FIG. 5), as shown at block 702. More specifically the controller 102 may utilize the sound classification module to determine the sound is a vacuum cleaner which has originated in work space $s_i$, as shown at block 704. In order to determine if the floor vacuuming (FV) is a normal occurrence (e.g., routine cleaning, etc.) or whether the floor vacuuming is being completed in a thorough manner, the controller 102 may analyze the previously obtained audio (for space $s_i$, and/or other rooms or areas in the building) to determine a probably of a vacuuming sound occurring along a time domain, as shown at block 706.

The controller 102 may then identify the time period or time periods ($t_i$ to $t_j$) where the floor vacuuming sounds are identified in spaces other than work space $s_i$ on a same floor (e.g., the $12^{th}$ floor) or area, as shown at block 708. In the illustrated example, this is shown as the $12^{th}$ floor of a building. The controller 102 may map the locations where floor vacuuming sounds are changing rapidly (e.g., as the person using the vacuum moves from one area to another, the sound will drop off in one area and pick up in another). The controller 102 may then compute or determine the audio path of the vacuuming sound through the area or zone (e.g., the $12^{th}$ floor), as shown at block 710. The audio path for the current vacuuming sound may then be compared to an average audio path that has been generated over a preceding period of time (e.g., a week, a month, etc.), as shown at block 712. In response to this comparison, a floor cleaning report may be generated and sent to one or more supervising or other users.

The floor cleaning report may provide information about the floor cleaning (e.g., vacuuming) including, but not limited, whether or not the cleaning occurred in all expected locations, when it occurred, how long it occurred, etc. Additionally, or alternatively, the floor cleaning report may be provided within a building situation report, as shown at block 714. The building situation report may include all abnormal or documented audio events that occurred over a specified time period in a building or complex. The situation report may be transmitted (e.g., e-mailed, texted, etc.) to one or more supervising or other users.

Figure 10:
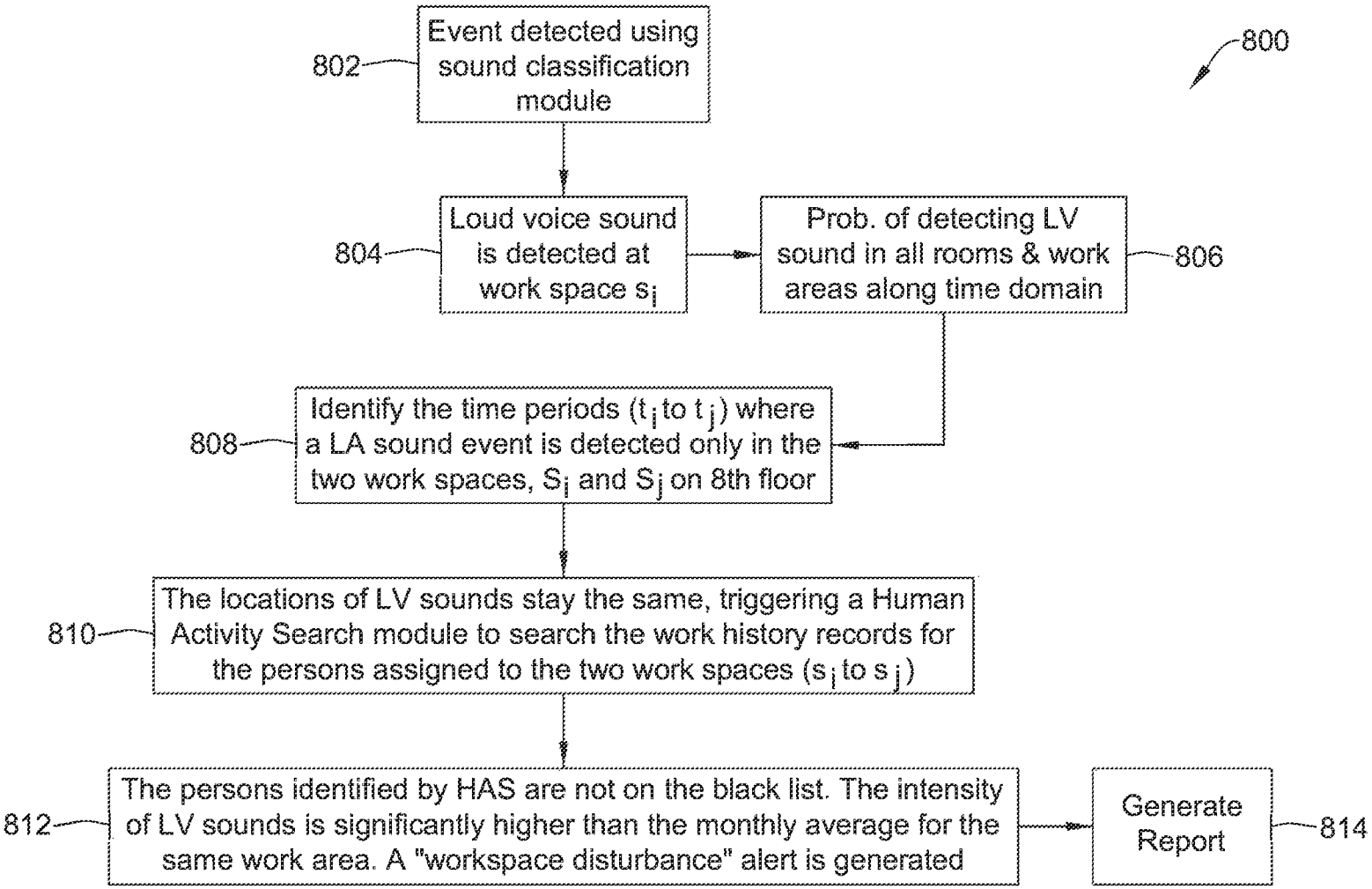

FIG. 10 is an illustrative flow chart 800 of an analysis of another illustrative sound event that may be detected using sound profiling system 100. To begin, a sound associated with human activity may be identified from filtered audio (e.g., steps 406 and 408 in FIG. 5), as shown at block 802. More specifically the controller 102 may utilize the sound classification module to determine the sound is a loud voice which has originated in work space as shown at block 804. In order to determine if the loud voice is a normal occurrence (e.g., a group of occupants returning from a break, etc.) or should be considered an abnormal event, the controller 102 may analyze the previously obtained audio (for work space $s_i$ and/or other rooms or areas in the building) to determine a probably of a loud voice sound occurring along a time domain, as shown at block 806. If it is determined that the volume, frequency and/or duration of the loud voice sound is a common occurrence or meets a predetermined probability, the controller 102 may take no further action.

If it is determined that the loud voice sound is not a common occurrence (e.g., is abnormal) or does not meet the predetermined probability, the controller 102 may identify the time period or time periods ($t_i$ to $t_j$) where a surge or difference from the normal pattern is emerging, as shown at block 808. In the illustrated example, this may be two adjacent work spaces $s_i$ and $s_j$ on the $8^{th}$ floor of a building. If the loud voices remain in a same location, the controller 102 may then search work history records to determine which occupants, if any are assigned to work spaces $s_i$ and $s_j$ on the $8^{th}$ floor of a building, as shown at block 810. The controller 102 may then determine if any of the occupants have been noted as having created prior disturbances. If the person has a history of creating disturbances, the controller 102 may send an alert to security personnel. If the people have not been previously identified as creating prior disturbances and the intensity of the loud voices is significantly higher than an average for the same area, a disturbance alert may be generated, as shown at block 812.

The disturbance alert may be transmitted to one or more supervising or other users. The disturbance alert may provide information about the abnormal event, how long it occurred, where it occurred, etc. The disturbance alert may prompt the supervising user to investigate a cause of the abnormal event. Additionally, or alternatively, the disturbance alert may be provided within a building situation report, as shown at block 814. The building situation report may include all abnormal or documented audio events that occurred over a specified time period in a building or complex. The situation report may be transmitted (e.g., e-mailed, texted, etc.) to one or more supervising users or other users.

Figure 11:
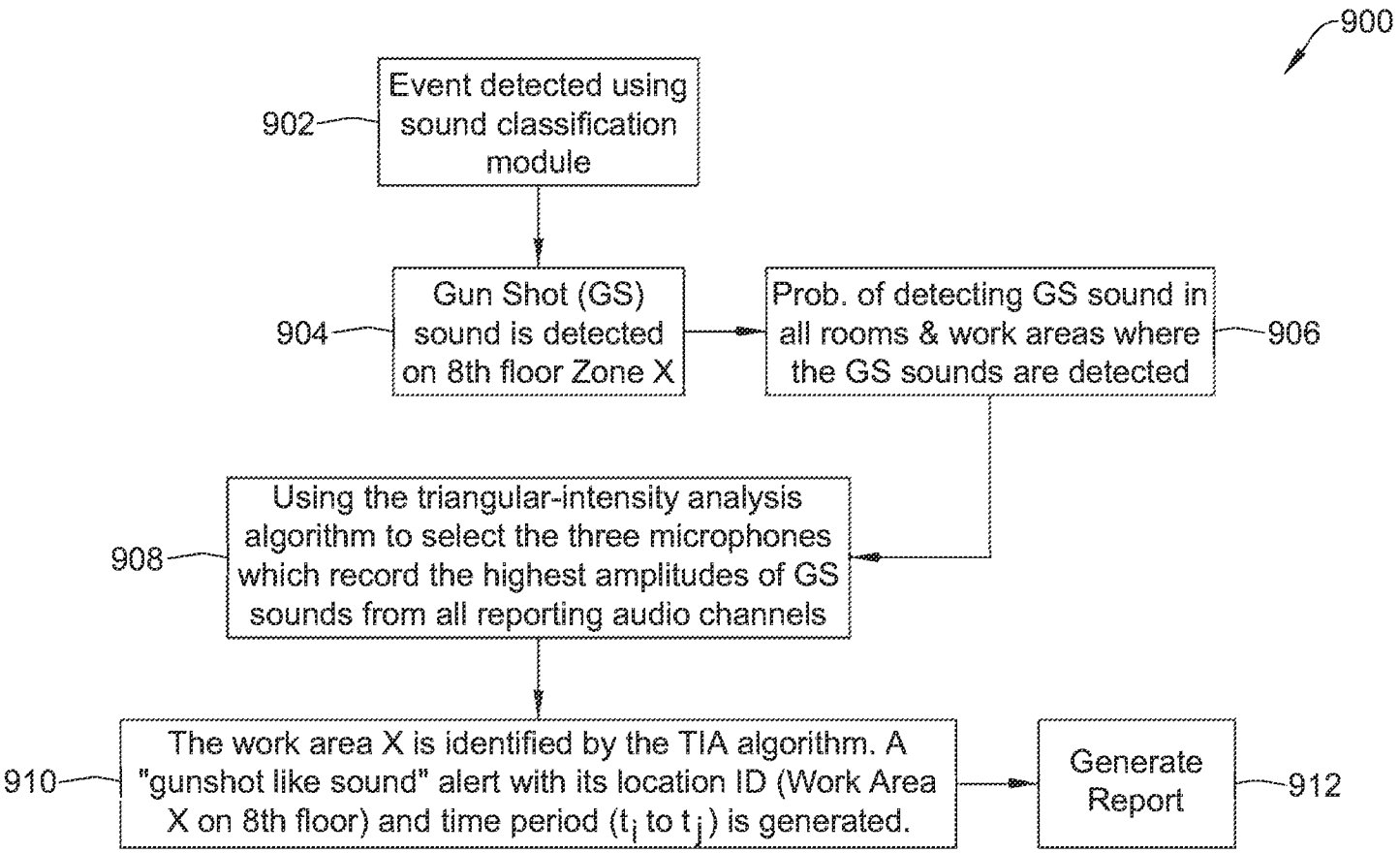

FIG. 11 is an illustrative flow chart 900 of an analysis of another illustrative sound event that may be detected using sound profiling system 100. To begin, a sound associated with human activity may be identified from filtered audio (e.g., steps 406 and 408 in FIG. 5), as shown at block 902. More specifically the controller 102 may utilize the sound classification module to determine the sound is a gunshot sound which has originated in Zone X on the $8^{th}$ floor, as shown at block 904. While not usually necessary in a gunshot scenario, the algorithm may determine if the gun shot sound is a normal occurrence or should be considered an abnormal event, the controller 102 may analyze the previously obtained audio (for Zone X and/or other rooms or areas in the building) to determine a probably of a gunshot sound occurring along a time domain, as shown at block 906. If it is determined that the volume, frequency and/or duration of the gun shot sound is a common occurrence or meets a predetermined probability setpoint, the controller 102 may take no further action.

In some cases, the controller 102 may use a triangular-intensity analysis algorithm to select which microphones or sound sensors 106 recorded the highest intensity of gunshot sounds from all reporting audio channels, as shown at block 908. This may help determine a specific origination location of the sound, as shown at block 910. The specific location and time period may be transmitted with a gunshot-like sound alert to a supervising user, security, law enforcement and/or other user. It is contemplated that the controller 102 may also scan the audio transmissions from other rooms and spaces on the $8^{th}$ floor (e.g., locations near Zone X) to determine if any other abnormal events have occurred during a similar time period. In some cases, the controller 102 may scan other BMS components to determine if other unusual events have occurred. It is contemplated that the generation of the gunshot-like sound alert may also trigger automatic changes to the BMS 12. For example, entrances and/or exits may be automatically locked to preclude people from entering Zone X until the area has been cleared.

The gunshot like sound alert may be transmitted to one or more supervising or other users. The gunshot like sound alert may provide information about the abnormal event, how long it occurred, where it occurred, etc. The gunshot like sound alert may prompt the supervising user to investigate a cause of the abnormal event. Additionally, or alternatively, the gunshot like sound alert may be provided within a building situation report, as shown at block 914. The building situation report may include all abnormal or documented audio events that occurred over a specified time period in a building or complex. The situation report may be transmitted (e.g., e-mailed, texted, etc.) to one or more supervising or other users Those skilled in the art will recognize that the present disclosure may be manifested in a variety of forms other than the specific embodiments described and contemplated herein. Accordingly, departure in form and detail may be made without departing from the scope and spirit of the present disclosure as described in the appended claims.

What is claimed is:

1. A method for identifying abnormal human activity in a building, the method comprising:

receiving real time audio captured in the building;

generating feature vectors based at least in part on the captured real time audio, wherein the feature vectors retain acoustic signatures unique to sounds in the real time audio, but the real time audio cannot be recreated from the feature vectors;

discarding the real time audio after the feature vectors are generated;

analyzing the sounds represented in the feature vectors to identify one or more sounds represented in the feature vectors that are associated with human activity;

determining when one or more of the sounds represented in the feature vectors that are associated with human activity are abnormal sounds; and issuing a notification when it is determined that one or more of the sounds represented in the feature vectors that are associated with human activity are determined to be abnormal.

2. The method of claim 1, further comprises:

comparing one or more of the sounds represented in the feature vectors that are associated with human activity with a normal human activity sound profile; and determining that one or more of the sounds represented in the feature vectors that are associated with human activity are abnormal when a difference between one or more of the sounds represented in the feature vectors that are associated with human activity and the normal human activity sound profile exceeds at least a threshold difference.

3. The method of claim 1, further comprising:

classifying one or more of the sounds represented in the feature vectors that are associated with human activity into one of a plurality of classifications of detected human activity;

comparing a classification of one or more of the sounds represented in the feature vectors that are associated with human activity with a normal classification of human activity sounds; and determining that one or more of the sounds represented in the feature vectors that are associated with human activity are abnormal when a difference between the classifications of one or more of the sounds represented in the feature vectors that are associated with human activity and the normal classification of human activity sounds exceeds at least a threshold difference.

4. The method of claim 3, wherein the plurality of classifications of detected human activity comprises one or more of voice, laughter, coughing, sneezing, running water, keyboard activity, cleaning equipment activity and gunshot activity.

5. The method of claim 3, wherein the normal classification of human activity sounds are learned over time using machine learning.

6. The method of claim 1, wherein the notification comprises one or more of a building occupant health alert, a workplace disturbance alert, a cleaning alert, and a gunshot-like sound alert.

7. The method of claim 6, wherein the notification comprises a building occupant health alert, and in response, and HVAC system of the building increases an air turnover rate.

8. The method of claim 1, further comprising:

storing a background sound profile, wherein the background sound profile is based at least in part on background sounds captured without a presence of humans; and wherein analyzing the sounds represented in the feature vectors to identify one or more sounds represented in the feature vectors that are associated with human activity comprises ignoring one or more background sounds represented in the feature vectors that are attributed to background sounds represented in the background sound profile.

9. The method of claim 1, comprising:

issue a notification when it is determined that a predetermined combination of two or more of the sounds represented in the feature vectors that are associated with human activity are determined to be abnormal within a predetermined period of time.

10. The method of claim 1, wherein:

capturing real time audio in the building comprises capturing real time audio from three or more spaced locations; and determining a location of a source of one or more of the sounds represented in the feature vectors by triangulating based on the real time audio captured at three or more of the three or more spaced locations.

11. The method of claim 1, further comprising:

receiving one or more sensed events triggered at least in part by one or more of a motion sensor, a light sensor, a temperature sensor, a humidity sensor, a carbon dioxide sensor, a pressure sensor, an occupancy sensor and a proximity sensor; and determining when one or more of the sounds represented in the feature vectors that are associated with human activity are abnormal sounds based at least in part on one or more of the sensed events.

12. A method for identifying abnormal human activity in a building, the method comprising:

receiving real time audio captured at each of three or more locations in the building;

generating feature vectors based at least in part on the captured real time audio, wherein the feature vectors retain acoustic signatures unique to sounds in the real time audio, but the real time audio cannot be recreated from the feature vectors;

discarding the real time audio after the feature vectors are generated;

analyzing the sounds represented in the feature vectors to identify one or more sounds represented in the feature vectors that are associated with human activity;

determining when one or more of the sounds represented in the feature vectors that are associated with human activity are abnormal sounds;

determining a location of a source of one or more of the abnormal sounds by triangulating based on the real time audio captured at three or more of the three or more locations in the building; and issuing a notification when it is determined that one or more of the sounds represented in the feature vectors that are associated with human activity are determined to be abnormal.

13. The method of claim 12, wherein the notification includes the location of the source of one or more of the sounds represented in the feature vectors that are associated with human activity determined to be abnormal.

14. The method of claim 12, further comprises:

comparing one or more of the sounds represented in the feature vectors that are associated with human activity with a normal human activity sound profile; and determining that one or more of the sounds represented in the feature vectors that are associated with human activity are abnormal when a difference between one or more of the sounds represented in the feature vectors that are associated with human activity and the normal human activity sound profile exceeds at least a threshold difference.

15. The method of claim 12, further comprising:

classifying one or more of the sounds represented in the feature vectors that are associated with human activity into one of a plurality of classifications of detected human activity;

comparing a classification of one or more of the sounds represented in the feature vectors that are associated with human activity with a normal classification of human activity sounds; and determining that one or more of the sounds represented in the feature vectors that are associated with human activity are abnormal when a difference between the classifications of one or more of the sounds represented in the feature vectors that are associated with human activity and the normal classification of human activity sounds exceeds at least a threshold difference.

16. The method of claim 15, wherein the plurality of classifications of detected human activity comprises one or more of voice, laughter, coughing, sneezing, running water, keyboard activity, cleaning equipment activity and gunshot activity.

17. The method of claim 15, wherein the normal classification of human activity sounds are learned over time using machine learning.

18. A method for identifying abnormal human activity in a building, the method comprising:

receiving real time audio captured in the building;

generating feature vectors based at least in part on the captured real time audio, wherein the feature vectors retain acoustic signatures unique to sounds in the real time audio, but the real time audio cannot be recreated from the feature vectors;

discarding the real time audio after the feature vectors are generated;

analyzing the sounds represented in the feature vectors to identify one or more sounds represented in the feature vectors that are associated with human activity;

determining when the sounds represented in the feature vectors that are associated with human activity are abnormal by an absence of an expected sound; and issuing a notification when it is determined that the sounds represented in the feature vectors that are associated with human activity are determined to be abnormal.

19. The method of claim 18, further comprises:

comparing one or more of the sounds represented in the feature vectors that are associated with human activity with a normal human activity sound profile, wherein the normal human activity sound profile includes the expected sound.

20. The method of claim 18, wherein the notification comprises one or more of a building occupant health alert, a workplace disturbance alert, a cleaning alert, and a gunshot-like sound alert.

* * * * *